US007514190B2

(12) United States Patent
Ohmura et al.

(10) Patent No.: US 7,514,190 B2
(45) Date of Patent: Apr. 7, 2009

(54) METHOD FOR FORMING AN ELECTROPHOTOGRAPHIC IMAGE

(75) Inventors: Ken Ohmura, Hachioji (JP); Asao Matsushima, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 419 days.

(21) Appl. No.: 11/042,510

(22) Filed: Jan. 26, 2005

(65) Prior Publication Data

US 2005/0208398 A1 Sep. 22, 2005

(30) Foreign Application Priority Data

Jan. 29, 2004 (JP) ..... 2004-020988
Jan. 29, 2004 (JP) ..... 2004-020989

(51) Int. Cl.
*G03G 13/01* (2006.01)

(52) U.S. Cl. ..... 430/45.54; 430/45.5; 430/45.55; 430/46.1; 430/47.2; 430/47.4; 430/107.1; 430/108.3; 430/108.4; 430/110.3; 430/111.4; 430/119.8; 430/119.86; 430/123.41; 430/123.43; 430/123.52

(58) Field of Classification Search ..... 430/45.5, 430/45.53, 45.54, 45.55, 46.1, 47.2, 47.4, 430/123.41, 123.43, 119.8, 119.82, 119.72, 430/119.86, 123.51, 123.52, 107.1, 111.4, 430/110.3, 108.3, 108.4
See application file for complete search history.

(56) References Cited

FOREIGN PATENT DOCUMENTS

| | | | |
|---|---|---|---|
| JP | 02-287363 | | 11/1990 |
| JP | 09-043878 | | 2/1997 |
| JP | 9-120225 | | 5/1997 |
| JP | 9-197882 | | 7/1997 |
| JP | 10-063032 | | 3/1998 |
| JP | 10-161495 | | 6/1998 |
| JP | 2001-242657 | | 9/2001 |
| JP | 2002-072534 | | 3/2002 |
| JP | 2002-091087 | | 3/2002 |
| JP | 2002-162878 | | 6/2002 |
| JP | 2002-278137 | * | 9/2002 |
| JP | 2002-287405 | | 10/2002 |
| JP | 2003-015453 | | 1/2003 |
| JP | 2003-084498 | | 3/2003 |

(Continued)

OTHER PUBLICATIONS

Japanese Patent Office machine-assisted translation of JP 2002-278137 (pub. Sep. 2002).*

(Continued)

*Primary Examiner*—Janis L Dote
(74) *Attorney, Agent, or Firm*—Finnegan, Henderson, Farbow, Garrett & Dunner, L.L.P.

(57) ABSTRACT

An electrophotographic image forming method is disclosed, which includes the steps of developing an electrostatic image on a electrophotographic photoreceptor by a developer, transferring a toner image formed by the development, and fixing the toner image on a recording medium. It is disclosed that a toner has a volume particle diameter (Dv50) of about 4.4 to about 5.8 μm and displays two or more endothermic peaks measured by DSC being within the rang of from about 50 to about 73° C. and the endothermic heat amount thereof is from 12.6 to 24.5 J/mg and a transferring member and/or a fixing member constituted by a belt containing a polyimide resin are employed in the method.

21 Claims, 3 Drawing Sheets

FOREIGN PATENT DOCUMENTS

| | | |
|---|---|---|
| JP | 2003-113306 | 4/2003 |
| JP | 2003-114544 | 4/2003 |
| JP | 2003-177630 | 6/2003 |
| JP | 2003-195554 | 7/2003 |
| JP | 2003-207946 | 7/2003 |

OTHER PUBLICATIONS

Office Action, mailed Jan. 15, 2008, in counterpart Japanese Patent Application No. 2004-020988.
Office Action, mailed Jan. 15, 2008, in counterpart Japanese Patent Application No. 2004-020989.

* cited by examiner

METHOD FOR FORMING AN ELECTROPHOTOGRAPHIC IMAGE

BACKGROUND

1. Field of the Invention

The present invention relates to an image forming method in which an electrostatic image on an electrophotographic photoreceptor is developed by a developer containing a toner and the developed image is transferred onto a transfer medium such as paper and fixed to form the image.

2. Related Art

In early cases, full color image forming methods by the electrophotography are mostly utilized for businesses of color photo copying and designer. Recently, however, a composite color printing machine usable either for color printer or color copier is frequently introduced into offices. It is the background of such the trend that the coast lowering, miniaturization and speedup of the machine are progressed and that a business document such as a planning paper and a report can be output by the composite color printing machine connected with a personal computer through network accompanied with the introduction of information technology into the office.

An "oil-less color machine" is sold on the market in which the trouble relating to oil, such as silicone oil, is dissolved by giving a parting property to the toner so that a high quality color image having an improved smoothness of the image surface after the fixing can be obtained, for example, Japanese Patent Tokkai Hei 9-120225 and Tokkai Hei 9-197882.

Though a color toner image inhibited in the glossiness is proposed by the maker, a glossy image is strongly needed by the users accompanied with the spreading of the oil-less color printing machine. Moreover, the requirement level of the users for expanding the color gamut of the toner image is raised day by day so that the color reproduction with high fidelity can be realized.

As the measures for satisfying such the needs for the color image, a technique is proposed in which an oil-less toner containing a large amount of a low-melting point wax so as to smooth the surface of the toner image by the wax, and a technique is also proposed in which the viscosity of molten toner is reduced so that the mutual permeability of the toners of yellow, magenta and cyan is raised. However, the required level by the users cannot be satisfied.

The technique of the addition of a large amount of the wax is advantageous compared with usual crushed toner since a chemical toner typified by polymerized toner has a high degree of freedom of wax addition in the course of production. However, the technique for adding the wax to the toner has arrived to limits.

Moreover, it is confirmed that the exuding rate of the wax in the fixing process is difficultly controlled to suitable when the toner containing a large amount of the wax is employed. Namely, the wax cannot be constantly exuded while the fixing process since the wax is rapidly exuded at the initial stage of the fixation. As a result of that, unevenness of the glossiness is considerably formed on the surface of the toner image after the fixation. Particularly, in a recent high speed machine combined with an apparatus for post-treating the printed matter such as a finisher or a book binder, a problem is posed such as that the printed matter is partially touched with a conveying parts constituting the above apparatus so that the portion of the printed matter touched with the conveying parts is immediately cooled and difference in the glossiness between the portion rapidly cooled and that naturally cooled.

Furthermore, chance of outputting a lot of monochromatic images from a color printer is increased accompanied with speed up of the office use color printer. In other words, the monochromatic printer is not needed for printing the monochromatic prints because the high speed printing can be performed by the color printer. However, filming on the constituting parts of the printer tends to occur when a lot of the monochromatic documents with low toner consumption are frequently printed by the image forming method originally designed for color printer. When the toner containing a large amount of the low-melting point wax is introduced in such the case, the frequency of the problem occasion is raised and the life of the parts such as an intermediate transfer member, fixing member and photoreceptor is shortened so as to need exchanging of them on half way or renewing of the printer itself.

As above-mentioned, an image forming method in which the wax contained in the oil-less toner can be constantly exuded in the fixing process is demanded.

SUMMARY

An embodiment of the invention is an electrophotographic image forming method comprising: developing an electrostatic image on an electrophotographic photoreceptor by a developer containing a toner, transferring thus obtained toner image, and fixing the toner image onto a recording medium, wherein the toner contains toner particles having a volume particle diameter ((Dv50)) of from about 4.4 to about 5.8 μm, and displays two or more endothermic peaks measured by DSC being between from about 50 to about 73° C. and the endothermic heat amount of from about 12.6 to about 24.5 J/mg, and a transfer member used for transferring and/or a fixing member used for fixing are constituted by a belt containing a polyimide resin.

DETAIL DESCRIPTION OF THE EXEMPLARY EMBODIMENT

Figure 1:
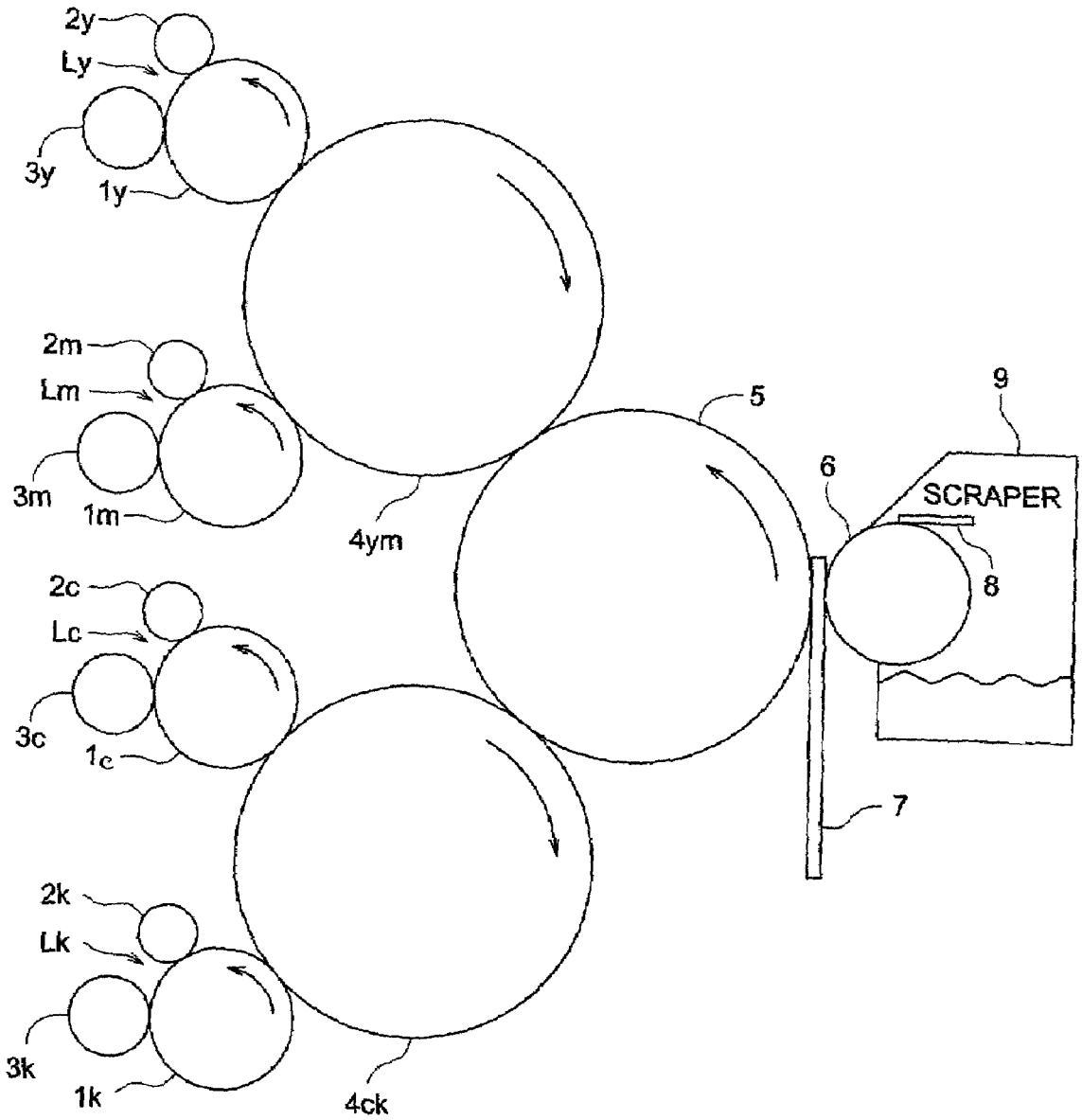
FIG. 1 shows a schematic drawing of an example of cleanerless system employed in the invention.

An embodiment of the invention is an electrophotographic image forming method comprising the steps of developing an electrostatic image on an electrophotographic photoreceptor by a developer containing a toner, transferring thus obtained toner image, and fixing the toner image onto a recording medium, wherein the toner contains toner particles having a volume particle diameter (Dv50) of from about 4.4 to about 5.8 μm, and displays two or more endothermic peaks measured by DSC being between from about 50 to about 73° C. and the endothermic amount of from about 12.6 to about 24.5 J/mg, and a transfer member used for transferring and/or a fixing member used for fixing are constituted by a belt containing a polyimide resin.

By the above constitution, at least a good image can be obtained and the angle dependency of glossiness or the variation of glossiness depending on the viewing angle to the image can be improved.

In the above, the volume particle diameter ((Dv50)) is the median diameter in the particle size distribution based on the volume.

In the above embodiment, the following embodiment is preferred.

The first embodiment is an electrophotographic image forming method including transferring the obtained toner image, and fixing the transferred toner image to a recording medium, in which the toner contains toner particles in which a) the average value of the circular degree of the toner particles is from 0.955 to 0.975; b) the volume particle diameter (Dv50) of the toner is from 4.5 to 5.8 μm; c) the toner displays an endothermic peak measured by DSC being between from 58 to 73° C. and the endothermic amount of the toner of from 12.6 to 24.5 J/mg, d) the toner contains at least two kinds of metal soap selected from an oleate, a palmitate, a stearate and myristate; and e) a transfer member used for transferring and/or a fixing member used for fixing are constituted by a belt containing a polyimide resin. By such the constitution, at least one of insufficient cleaning, occurrence of filming and deformation and color displacement of dots on the photoreceptor and the intermediate transfer member can be improved even when the toner containing a large amount of the low-melting point wax and the variation of the glossiness feeling depending on the viewing angle also can be improved; the glossiness feeling is varied depending on the viewing angle since light is reflected by both of the wax layer of the fixed image and by the interface of the colorant and the resin after passing through the wax layer.

The second preferable embodiment is an electrophotographic image forming method comprising transferring the obtained toner image, and fixing the transferred toner image to a recording medium, wherein the toner contains toner particles in which f) the molecular weight distribution of the tetrahydrofuran soluble components of the toner has peaks within the range of from 1,100 to 18,000 and that of from 500 to 2,000; g) the toner has a volume particle diameter (Dv50) of from 4.5 to 5.8 μm; h) the toner shows two or three endothermic peaks in the course of temperature rising measured by DSC being within the range of from 50 to 73° C., an endothermic heat amount of from 12.6 to 24.5 J/mg and one to three exothermic peaks in the course of temperature lowering measured by DSC being within the range of from 45 to 70° C., and the half band width of the largest exothermic peak in the course of cooling is larger than the half band width of the largest endothermic peak in the course of heating; and i) a transfer member used for transferring and/or a fixing member used for fixing are constituted by a belt containing a polyimide resin.

By the above constitution, an image can be obtained which has high glossiness without the dependence on the viewing angle and wide color gamut capable of reproducing color with high fidelity even when the image is formed by employing the oil-less toner containing a large amount of wax, moreover, the occurrence of unevenness in the glossiness by the high speed machine can be dissolved and the suitability to the cleaning-less process can be improved.

The first embodiment is described in detail below.

In the first embodiment, the insufficient cleaning, occurrence of filming and deformation and color displacement of dots on the photoreceptor and the intermediate transfer member can be improved even when the toner containing a large amount of the low-melting point wax and the variation of the glossiness feeling depending on the viewing angle also can be improved; the glossiness feeling is varied depending on the viewing angle since light is reflected by both of the wax layer of the fixed image and by the interface of the colorant and the resin after passing through the wax layer.

The a), c) and e) of the first embodiment are effective to improve the occurrence of the insufficient cleaning and the filming on the photoreceptor and the intermediate transfer belt. It is preferable to forming a shell layer containing no parting agent having a thickness of from 0.1 to 1.0 μm in the section of the particle. The shell layer is preferably from 20 to 50% by weight of the toner.

The deformation and the color displacement of the dot in the fixing process tend to be caused by that the pressing member of the fixing device is moved according to the heating member of that, the b) and d) of the first embodiment is effective for improving such the problem. By such the measure, a gap between the paper and the toner layer caused by the thickness is difficultly formed. It is supposed that the effect of the d) is caused by adhesion of the toner together with the wax onto the fixing member of polyimide so as to stabilize the conveying ability of the paper. When the pressing member for fixing is constituted in an endless belt and pressed to the heating member for fixing by a pressing pad, silicone oil having a viscosity of from 0.5 to 10 Pa·s is preferably coated inside or the pressing pad side of the belt. The coating is preferably performed by employing a pad immersed with the oil. It is also effective to use a material in which the oil is contained in a dispersed state.

For the first embodiment, an image forming method is preferable which satisfying the state of that the charge generation layer of the photoreceptor contains a gallium phthalocyanine compound as the charge generation material, the charge transfer layer contains a benzidine compound and/or a triarylamine compound as the charge transfer material and a blade, brush, polishing or an abrasive sheet is touch to the photoreceptor and/or transferring member. The occurrence of filming by the wax on the photoreceptor can be inhibited by such the constitution. Moreover, the parts can be cleaned by removing the filming substance and held clean by touching the blade, polishing or an abrasive sheet to the intermediate transfer member. A sheet of PET or urethane in which silica is dispersed can be employed as the abrasive sheet.

The volume particle diameter (Dv50) is within the range of from 4.4 to 5.8 μm, and preferably from 4.7 to 5.4 μm. For example, in a case of an emulsion-association type toner, the volume particle diameter (Dv50) can be controlled by controlling the timing for adding the coagulation stopping agent in the course of the resin particle formation. The volume particle diameter (Dv50) can be measured by a sheath flow type particle size measuring apparatus SD 2000, manufactured by Sysmex Co., Ltd., with an orifice of 30 μm.

The toner of the first embodiment shows the endothermic peaks measured by DSC being within the range of from 58 to 73° C. and the endothermic heat amount thereof is within the range of from 12.6 to 24.5 J/mg. The endothermic peaks are preferably within the range of from 60 to 71° C. Moreover, it is desirable that the endothermic peaks are within the range of from 58 to 71° C., particularly from 62 to 67° C. and the endothermic heat amount is within the range of from 13.6 to 24.5 J/mg. In the measuring method by DSC, for example, the sample is stood for 1 minute at 0° C. and then heated by 200° C. in a rate of 10° C./minute and the temperature and the heat amount at the endothermic peak detected in the course of the temperature rising are detected. Concrete example of the differential thermal analyzer includes DSC-7 manufactured by Perkin-Elmar Co., Ltd.

The toner particles preferably have an average value of circular degree expressed by the following expression of from 0.955 to 0.975 when the measurement is performed as to 2,000 particles each having a particle diameter of not less than 1 μm. When the average circular degree is within the above range, the filling density of the transferred image is raised and the heat conduction between the toner particles is improved and the fusion and permeation of each color toners are accelerated so that the color gamut can be expanded.

Circular degree=(Circumference length of corresponding circle)/(Circumference length of projection image of toner particle)=$2\pi\times$(Projection area of particle/$\pi)^{1/2}$/(Circumference length of projection image of toner particle)

In the above, the corresponding circle is a circle having an area the same as that of the projection image of the toner particle. The circular degree can be measured by FPIA-1000 Sysmex Co., Ltd. The corresponding circle diameter is defined by the following expression.

$$\text{Corresponding circle diameter}=2\times(\text{Projection area of particle}/\pi)^{1/2}$$

The toner of the first embodiment contains a metal soap, namely, at least two, preferably three or more, kinds of metal salts selected from those of oleic acid, palmitic acid, stearic acid and myristic acid. Examples of the metal for forming the meat salt include aluminum, indium, gallium, zinc, calcium, lithium, magnesium and sodium. Among them, zinc and calcium are preferred.

It is confirmed that the image defects such as the density lowering at the center portion of solid image and the character scattering are improved in the toner image formed by the toner containing the metal soaps and the cleaning ability of the photoreceptor and-the intermediate transfer member is raised.

The above-described metal salts of the higher fatty acids are usable. The content of the metal soap is preferably from 0.1 to 5% by weight of the toner particles. As the means for adding and mixing the metal soap with the toner particles, various known mixing apparatus such as a tabular mixer, HENSCHEL-MIXER, Towner mixer and V-type mixer are usable.

The second embodiment is described below.

By the image forming method using the oil-less toner containing a large amount of wax according to the second embodiment, the image forming method can be provided by which an image having high glossiness without dependency on viewing angle and wide color gamut capable of reproducing color with high fidelity can be formed, and the occurrence of unevenness of glossiness by the high speed machine can be dissolved, furthermore the suitability to the cleaning-less processing can be raised.

The second embodiment is obtained as a result of selection of the diameter of the toner particle, the molecular weight of the binder resin constituting the toner and the melting point of the wax so that the toner has no dependency on the cooling hysteresis, and the unevenness in the glossiness on the toner image after fixing can be improved by forming a wax layer not forming diffused reflection at the surface of the image.

The toner relating to the second embodiment has the following properties of f) to i).

f) In the molecular weight distribution of the tetrahydrofuran soluble components of the toner, peaks are observed between 11,000 to 18,000 and 500 to 2,000.

g) The volume particle diameter (Dv50) is from 4.4 to 5.8 μm.

h) Two or three endothermic peaks measured by DSC in the course of heating are within the range of from 50 to 73° C. and the endothermic heat amount is within the range of from 12.6 to 24.5 J/mg.

i) One to three exothermic peaks measured by DSC in the course of cooling are within the range of from 45 to 70° C. and the half wave width of the largest exothermic peak is larger than that of the largest endothermic peak.

Regarding the exothermic peak in the course of cooling, the tendency is observed that a new peak is formed or the peak being at the low temperature side is grown according to the receipt of the toner even when the same wax is employed. Furthermore, plural exothermic peaks are observed in the course of cooling of the toner, and it is found by the inventor that the occurrence of unevenness in the glossiness is inhibited when the exothermic heat amount at the peak appeared at the lower temperature side is smaller. It is also found by the inventors as a of their investigation on the tendency of the occurrence of the exothermic peaks in the course of cooling that the peaks in the cooling course is varied depending on the kind of the colorant constituting the toner. Such the tendency is considerably displays in the magenta toner, and it is found that magenta toners according to the following two kinds of receipts (a) and (b) are suitable for forming a toner image without occurrence of unevenness in glossiness.

(a) One employing a quinacridone pigment, a diketopyrrole and/or strontium salt of a carmine pigment as the colorant (b) One employing C. I. Pigment Red 31 and C. I. Pigment Red 150, preferably mixed crystal thereof.

It is confirmed that the toners employing the above (a) or (b) displays transferring rate higher than usual toners and it is further confirmed that the toners are suitably used for the cleanerless process such as that described in Japanese Patent Tokkai 2003-162136 when the circular degree of the toner particles is made within the range near the true circle, in concrete an average circular degree of from 0.979 to 0.996.

The volume particle diameter (Dv50) of the toner of the second embodiment is from 4.4 to 5.8 μm, and preferably from 4.7 to 5.4 μm. For example, in a case of an emulsion-association type toner, the volume particle diameter (Dv50) can be controlled by controlling the timing for adding the coagulation stopping agent in the course of the resin particle formation. The volume particle diameter (Dv50) can be measured by a sheath flow type particle size measuring apparatus SD 2000, manufactured by Sysmex Co., Ltd., with an orifice of 30 μm.

The toner by the second embodiment displays two or three endothermic peaks measured by DSC (differential thermal analysis) being within the range of from 50 to 73° C. and the endothermic heat amount is from 12.6 to 24.5 J/mg, and preferably one to three endothermic peaks are within the range of from 45 to 70° C., furthermore, it is a feature that the half band width of the largest exothermic peak in the course of cooling is larger than the half band width of the largest endothermic peak in the course of heating. In the measuring method by DSC, for example, the sample is stood for 1 minute at 0° C. and then heated by 200° C. in a rate of 10° C./minute and the temperature and the heat amount at the endothermic peak detected in the course of the temperature rising are detected. Concrete example of the differential thermal analyzer includes DSC-7 manufactured by Perkin-Elmar Co., Ltd.

As the binder resin, one is preferable of which tetrahydrofuran soluble components has peaks of the molecular weight distribution being between 14,000 to 17,000 and 500 to 1,000, and it is desirable that a dip formed by the two peaks is between 1,200 to 3,000 and the dissolution starting molecular weight is from 100,000 to 1,500,000. The measurement of the molecular weight is carried out by GPS (gel permeation chromatography) using THF (tetrahydrofuran).

(Average value of circular degree of toner particles)

The definition of the circular degree is the same as that in the first embodiment, but the range thereof is different in the second embodiment. Namely, the average value of the circular degree (shape coefficient) is from 0.979 to 0.996. When the average circular degree is within the above range, the filling density of the transferred image is raised and the heat conduction between the toner particles is improved and the fusion and permeation of each color toners are accelerated so that the color gamut can be expanded.

It is desirable that the average value of the circular degree of the toner particles is from 0.979 to 0.996, the two or three endothermic peaks measured by DSC in the course of heating are within the range of from 50 to 71° C. and the endothermic heat amount is from 13.4 to 24.5 J/mg.

The production method of the toner for developing electrostatic image is described below.

The toner is preferably at least a toner obtained by polymerizing a polymerizable monomer in an aqueous medium, and at least a toner obtained by associating resin particles in an aqueous medium. Namely, a suspension polymerization method and a method in which a monomer is emulsified and polymerized in a liquid (aqueous medium) containing an emulsion of necessary additive to prepare fine polymer particles (resin particles) and then the resin particles are associated by adding an organic solvent and a coagulation agent are applicable to produce the toner. The "association" means fusion of the plural resin particles with together and that of the resin particles with other particles such as a colorant particles.

Though the production method of the toner particle is not specifically limited, a method in which resin particles are prepared by an emulsion polymerization method and the resin particles are associated to form a toner particle dispersion and a method in which a toner particle dispersion is prepared by suspension polymerization are concretely applicable. For example, a method in which resin particles containing a parting agent formed by a poly-step polymerization method are salted out/fused (simultaneous progression of coagulation and disappearance of the interface of the resin particles) in an aqueous medium to prepare the toner particles such as that described in Japanese Patent Tokkai Nos. 2002-49180 and 2002-131978, and a method in which a colorant dispersion and a parting agent particle dispersion are mixed with a resin particle dispersion prepared by emulsion polymerization to form coagulated particles and then the coagulated particles are heated and fused to produced the toner particles such as that described in Japanese Patent Tokkai No. 2001-131877, are applicable.

As above-described, the toner can be produced by putting raw materials into an aqueous medium to perform polymerization reaction and then subjecting to a ripening process.

The toner particles are separated from the toner particle dispersion prepared by the above-described processes to prepare a toner cake, and then the toner cake is washed by water for removing adhering materials such-as a surfactant. For solid-liquid separation, a centrifugal method using a rotating cylinder type dehydrator, a vacuum filtration method using a Nutsche funnel and a method using a filter press are applicable. Among them, the centrifugal separation method is preferred.

The washed toner cake is dried to prepare the toner. Though the method for drying is not specifically limited, a vacuum drying is preferable. Examples of the vacuum drying machine include a vacuum spraying dryer, a vacuum freezing dryer and a vacuum dryer are applicable but the dryer is not limited to them. In concrete, a standing rack dryer, a movable rack dryer, a fluid bed dryer, a rotating dryer and a stirring dryer, each are capable of reducing pressure, are preferably employable. The toner to be employed in the invention can be produced by the above-described processes.

Preferable molecular weight, range of molecular weight and peak molecular weight of the resin component constituting the toner for developing electrostatic image are described below.

The resin constituting the toner employed in the invention (particularly in the first aspect) is preferably one showing a peak or shoulder of the molecular weight distribution within each of the range of from 100,000 to 1,000,000 and the range of from 1,000 to 50,000. Namely, a resin at least containing a high molecular weight component having a peak or shoulder within the range of from 100,000 to 1,000,000 and a low molecular weight component having a peak or shoulder within the range of from 1,000 to less than 50,000. The measurement of the molecular weight is performed by GPS (gel permeation chromatography) using THF (tetrahydrofuran) as the column solvent.

The parting agent employable in the toner is described below.

The parting agent is not specifically limited as long as it is effective to form the endothermic peaks of the toner within the range of from 50 to 73° C., particularly from 58 to 73° C., when the toner is measured by DSC-7 as above-described.

The content of the parting agent in the toner is usually from 10 to 30%, preferably from 12 to 20%, and more preferably from 15 to 20%, by weight of the toner.

Ester type compounds represented by the following formula are preferable as the parting agent.

$$R_1—(OCO—R_2)_n \qquad \text{Formula}$$

In the formula, n is an integer of from 1 to 4, preferably from 2 to 4, more preferably 3 or 4, and particularly preferably 4.

$R_1$ and $R_2$ are a hydrocarbon group which may have a substituent.

The number of carbon atoms in $R_1$ is from 1 to 40, preferably from 1 to 20, and more preferably from 2 to 5, and that in $R_2$ is from 1 to 40, preferably from 16 to 30, and more preferably from 18 to 26. Concrete examples of the ester compound are listed below. Among them, ones having a melting point forming the endothermic peaks within the range of from 50 to 73° C., particularly from 58 to 73° C., such as behenyl behenate and stearyl stearate are preferable.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

-continued

7)

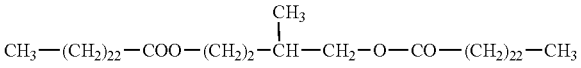

8)

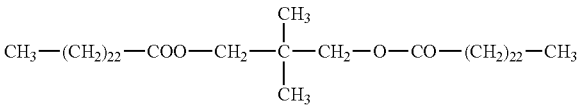

9)

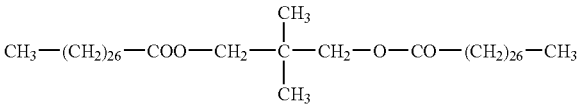

10)

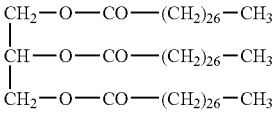

11)

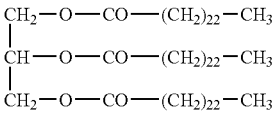

12)

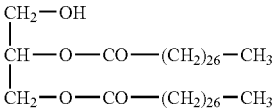

13)

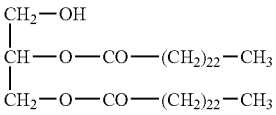

14)

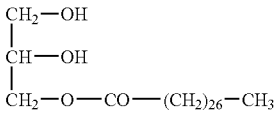

15)

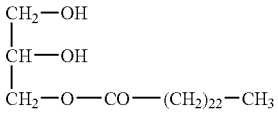

16)

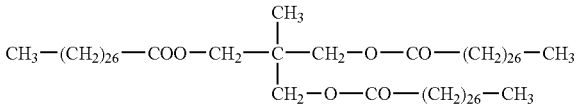

17)

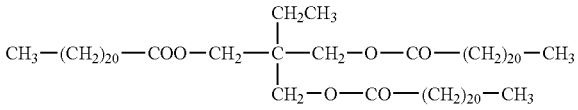

-continued

18)

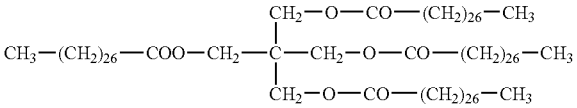

19)

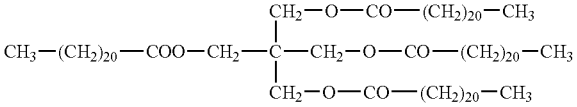

20)

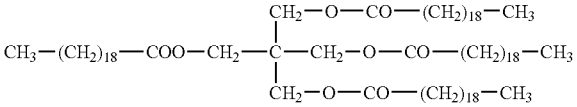

21)

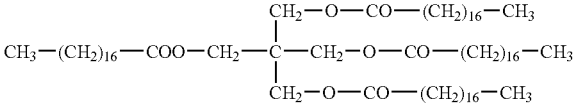

A monomer capable of being the raw material of the resin constituting the toner is described below.

A hydrophobic monomer can be employed for the raw material of the toner. Known hydrophobic monomers can be employed as the monomer for constituting the monomer component. One or more kinds of the monomer can be employed in combination for satisfying the required properties. A crosslinkable monomer may be further added for improving the properties of the resin particle. Furthermore, a monomer having an acidic polar group such as (a) an α,β-ethylenic unsaturated compound having a carboxyl group (—COOH) and (b) an α,β-ethylenic unsaturated compound having a sulfonic group (—$SO_3H$) are employable. A crosslinking agent and a polymerization initiator can be optionally used. Concrete examples of the above are described in paragraphs [0190] to [0211] and [0215] to [0218] of US2002/037469A1. The description of paragraphs [0190] to [0211] and [0215] to [0218] of US2002/037469A1 are herein incorporated by reference in the present application.

A chain-transfer agent is described below.

A usually used known chain-transfer agent can be employed for controlling the molecular weight of the resin particle formed by polymerization of the polymerizable monomer.

Though the chain-transfer agent is not specifically limited, a compound having a mercapto group is preferable since the toner having a sharp molecular weight distribution can be obtained, which is superior in the storage ability, fixing strength and anti-offset ability. For example, a compound having a mercapto group such as octanethiol, dodecanethiol and tert-dodecanethiol is usable. For example, ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, thioglycolic acid ester of ethylene glycol, thioglycolic acid ester of neopentyl glycol and thioglycolic acid ester of pentaerythrytol can be cited. Among them, n-octyl-3-mercaptopropionic acid ester is preferably employed from the viewpoint of inhibition of bad odor produced on the occasion of the thermal fixing of the toner.

<<Colorant>>

The colorant constituting the toner is described below.

The colorants related to the toners of four colors, yellow, magenta, cyan and black, each for developing the electrostatic image are preferably contained in the colored particle by sating out, coagulating and fusing together with the resin particles on the occasion of salt out, coagulation and fusion of the foregoing composite resin particles in the toner production process.

A magenta toner excellent in the color reproducibility can be obtained, particularly in the second embodiment, by using the combination of a quinacridone pigment and a diketopyrrole pigment or a quinacridone pigment and a strontium salt of carmine pigment. Other than the above, known inorganic pigments and organic pigments can be employed.

As the black pigment for the black toner, for example, carbon black such as furnace black, channel black, acetylene black, thermal black and lamp black are usable, particularly a neutral carbon black such as Regal 660 is preferred. When the neutral carbon black is employed, take in of the carbon black into the toner particle is improved so that the carbon black released from the toner particle is reduced. Therefore, the hindrance on the charging such as contamination of carrier is not resulted. Moreover, the use of the neutral carbon black brings a merit such as that the deepness of the black image and gradation of the image is increased. As the magnetic powder, magnetite and ferrite can be employed.

Such the inorganic pigments can be employed singly or in combination of plural kinds thereof. The content of the inorganic pigment in the toner is preferably from 2 to 20%, and more preferably from 3 to 15%, by weight.

When the toner is used as a magnetic toner, the foregoing magnetite can be added. In such the case, the content of the magnetite in the toner is preferably from 20 to 120% by weight for giving the designated magnetic properties.

Concrete examples of organic pigment employable in the toner are as follows.

The following organic pigments can be employed in combination as the colorant.

Examples of the organic pigments for magenta or red include C. I. Pigment Red 2, C. I. Pigment Red3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Examples of orange or yellow organic pigment to be used for preparation of the yellow toner include C. I. Pigment orange 31, C. I. Pigment Orange 43, C. I. Pigment Yellow 12, Pigment Yellow 13, Pigment Yellow 14, Pigment Yellow 15, Pigment Yellow 17, Pigment Yellow 93, Pigment Yellow 94, Pigment Yellow 138, Pigment Yellow 180, Pigment Yellow 185, Pigment Yellow 155 and Pigment Yellow 156.

Examples of green or cyan pigment to be used for preparation of the cyan toner include C. I. Pigment Blue 15, C. I. Pigment Blue 15:2, C. I. Pigment Blue 15:3, C. I. Pigment Blue 16, C. I. Pigment Blue 60 and C. I. Pigment Green 7.

As the dye, C. I. Solvent Red 1, 49, 52, 58, 63, 111 and 122, C. I. Solvent Yellow 19, 44, 77, 79, 81, 82, 93, 98, 103, 104, 112 and 162, and C. I. Solvent Blue 25, 36, 60, 70, 93 and 95 are exemplified. These dyes may be employed singly or in a mixture state of plural kinds thereof.

Moreover, these organic pigments and the dyes may be selected singly or a combination of plural kinds thereof. The content of the foregoing organic pigments or dyes in the toner is preferably from 2 to 20%, and more preferably from 3 to 15%, by weight of the toner.

The colorant (colorant particle) may be subjected to surface modifying. As the surface modifying agent, known ones such as a silane coupling agent, a titanium coupling agent and an aluminum coupling agent can be employed.

The adding amount of the surface modifying agent is preferably within the range of from 0.01 to 20% by weight, and more preferably within the range of from 0.1 to 5% by weight.

<<Charge Controlling Agent>>

The colored particles constituting the toner may further contain an internal additive other than the parting agent such as a charge controlling agent. As the charge controlling agent to be contained in the colored particle, a nigrosine dye, a metal salt of naphthenic acid or a higher aliphatic acid, an alkoxylized amine, a quaternary ammonium chloride, an azo metal complex, and a metal salt of salicylic acid or a metal complex thereof are employable.

<<Developer>>

The developer is described below.

The toner may be used either for a single-component developer or a double-component developer. When the toner is used for single-component developer, the developer either may be a non-magnetic single-component developer or a magnetic single-component developer containing magnetic particles having a diameter of about 0.1 to 0.5 μm.

The toner can be used as a double-component developer by mixing with a carrier. The volume particle diameter (Dv50) is from 15 to 100 μm, and more preferably from 25 to 80 μm.

Paragraphs [0304] to [0306] of US2002/0038469A1 describe about the carrier. The description of [0304] to [0306] of US2002/0038469A1 is herein incorporated by reference in the present specification.

<<Photoreceptor>>

The photoreceptor is described below.

The photoreceptor is electrophotographic photoreceptors to be employed for electrophotographic image formation. The effects of the invention are considerably enhanced when the toner is applied for an organic photoreceptor. The organic photoreceptor is a photoreceptor in which at least one of the essential functions, a charge generation function and a charge transfer function, of the photoreceptor is allocated to an organic compound. The organic photoreceptor entirely includes known organic photoreceptors such as photoreceptors constituted by a known organic charge generation material and a known organic charge transfer material and photoreceptors in which the charge generation function and the charge transfer function are allocated to a polymer complex.

The constitution of the organic photoreceptor is described below.

Though either a sheet-shaped or a cylindrical electroconductive substrate may be used for the photoreceptor, the cylindrical electroconductive substrate is preferable for designing a compact image forming apparatus. The cylindrical electroconductive substrate is a cylindrical substrate capable of endlessly forming images by rotating and an electro conductive substrate having a true straightness degree of not more than 0.1 mm and a swinging of not more than 0.1 mm is preferred. When the true straightness and the swinging exceed the above range, good images are difficultly obtained. A drum of metal such as aluminum and nickel, a plastic drum deposited with aluminum, tin oxide or indium oxide and a paper-plastic drum coated with an electroconductive substance can be employed as the electroconductive material. The electroconductive substrate preferably has a specific resistivity of not more than 103 Ωcm.

An intermediate layer having functions of adhesive ability improving and electrical barrier may be provided between the electroconductive substrate and the photosensitive layer. The thickness of the intermediate layer employing a hardenable metal resin is preferably from 0.1 μm to 5 μm.

The photosensitive layer of the photoreceptor preferably has a constitution in which the function of the photosensitive layer is separated into a charge generation layer (CGL) and a charge transfer layer (CTL). The remaining potential accompanied with repeating use can be controlled to low and another electrophotographic property can be easily controlled by taking the function separated constitution. In a photoreceptor to be negatively charged, a constitution is preferable in which the charge generation layer (CGL) is provided on the intermediate layer and the charge transfer layer (CTL) is provided on the charge generation layer. In a photoreceptor to be positively charged, the order of the layer structure is reveres to the case of the negatively charging photoreceptor.

The photosensitive layer constitution of the function separated type negatively charging photoreceptor is described below.

The charge generation layer contains a charge generation material (CGM). Other than that, a binder and another additive may be contained.

Known charge generation materials (CGM) can be employed as the charge generation material (CGM). For example, a phthalocyanine pigment, an azo pigment, a perylene pigment and an azulenium pigment can be employed. Among them, CGM capable of minimizing the remaining potential accompanied with repeating use is one having a steric and electrical structure which can form a stable aggregating structure. In concrete, the phthalocyanine pigment, particularly, a gallium phthalocyanine compound is preferred.

The photoreceptor employing the gallium phthalocyanine compound shows high sensitivity at the wavelength of a near infrared semiconductor laser (780 to 830 nm) and stable electric properties for a long period. Concrete examples of the gallium phthalocyanine include gallium phthalocyanine displaying intense diffraction peaks in the CuKa X-ray diffraction spectrum at Bragg angles (2θ±0.2°) of 6.8°, 12.8°, 15.8° and 26.0°, hydroxygallium phthalocyanine displaying intense diffraction peaks at 7.5°, 9.9°, 12.5°, 16.3°, 18.6°, 25.1° and 28.3° and chlorogalium phthalocyanine displaying intense peaks at 7.4°, 16.6°, 25.5° and 28.3°.

When a binder is employed in the charge generation layer for the dispersing medium of CGM, a formal resin, a butyral resin, a silicone resin, a silicone-modified butyral resin and a phenoxy rein are usable. The ratio of the binder resin to the CGM is preferably from 200 to 600 parts by weight to 100 parts by weight of the binder resin. The increasing of remaining potential accompanied with repeating used can be minimized by the use of such the resins. The thickness of the charge generation layer is preferably from 0.01 to 2 μm.

The charge transfer material (CTM) and a binder resin for dispersing CTM are contained. As the charge transfer material (CTM), for example, a triarylamine compound, a hydrazone compound, a styryl compound, a benzidine compound and a butadiene compound are employable. It is confirmed that the formation of clearer image is accelerated and the improvement in the foregoing objects of the invention is considerably enhanced by the use of the benzidine compound or the triarylamine compound. It is supposed that such the effects are caused by improving the latent image formation by dissolving the difference of dielectric constant in the photoreceptor by the effect of such the compound to improve the developing ability and the transferring ability.

As the benzidine compound, a compound represented by the following Formula IV is preferred.

(IV)

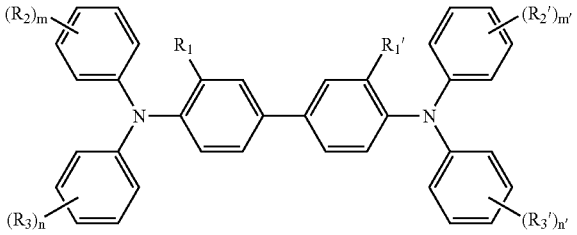

In the above formula, $R_1$ and $R_1'$ are each a hydrogen atom, an alkyl group, an alkoxyl group or a halogen atom; and $R_2$, $R_2'$, $R_3$ and $R_3'$ are each a hydrogen atom, an alkyl group, an alkoxyl group, a halogen atom or a substituted amino group. m, m', n and n' are each an integer of 1 or 2.

Among the benzidine compounds represented by Formula IV, compounds represented by Formula IV-i or IV-ii are preferably employed.

(IV-i)

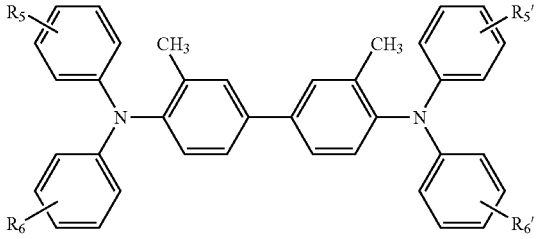

(IV-ii)

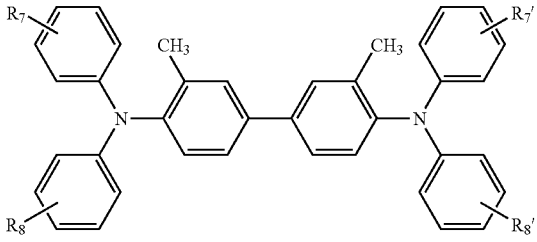

In the above formulas, $R_5$, $R_5'$, $R_6$ and $R_6'$ are each a hydrogen atom or a methyl group; $R_7$ and $R_7'$ are each an alkyl group having 2 or more carbon atoms; and $R_8$ and $R_8'$ are each a hydrogen atom, an alkyl group, an alkoxyl group or a substituted amino group.

These compounds have high solubility to a solvent and high permissibility with the polycarbonate resin so that a uniform coated layer can be obtained. Therefore, a uniform interface can be formed and an electrophotographic photoreceptor having high sensitivity and excellent in the stability during repeating used can be produced.

Compounds represented by the following Formula V are preferable as the triarylamine compound.

(V)

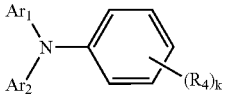

In the above Formula, $R_4$ is a hydrogen atom or a methyl group; $Ar_1$ and $Ar_2$ are each a halogen atom, an alkyl group, an alkoxyl group, or an aryl group or thienyl group each may have a substituted amino group; and k is an integer of 1 or 2.

Benzidine compounds represented by the above formulas are described in Paragraphs [0019] to [0024] of Japanese Patent No. 3250368 but the usable compound is not limited to them.

Copolymerized carbonate resins represented by the following Formulas I, II or III are employed for the binder resin in the charge transfer layer.

(I)

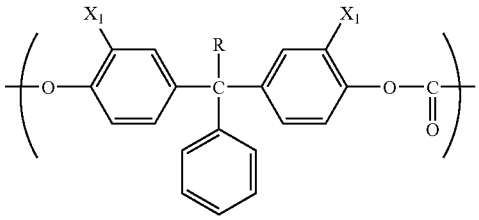

(II)

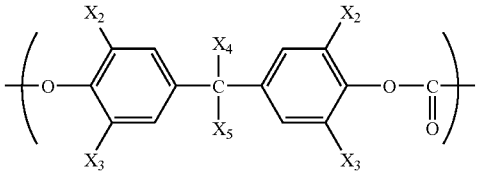

(III)

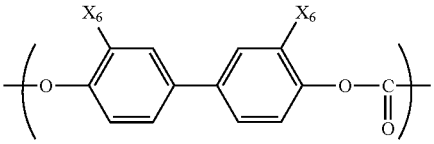

In the above formulas, R is a hydrogen atom, a methyl group or an aryl group; $X_1$, $X_2$ and $X_3$ are each a hydrogen atom, a halogen atom, an alkyl group, an aryl group, an aryl-substituted alkyl group or a cyclohexyl group; $X_4$ and $X_5$ are each a hydrogen atom, an alkyl group, an aliphatic hydrocarbon group, an aryl group, an aryl-substituted alkyl group or a group of atoms necessary for forming a carbon ring or a lactone ring by linking together with $X_4$ and $X_5$, provided that $X_4$ and $X_5$ are not the same as R in Formula I and a phenyl group; and $X_6$ is a hydrogen atom or a methyl group.

As examples of $X_2$ to $X_6$ in Formula II, substituents described in Japanese Patent No. 3250368 are cited.

As the copolymerized carbonate resin composed of the repeating units each represented by Formulas I, II and III, one having an viscosity-average molecular weight of from 10,000 to 200,000, and preferably from 20,000 to 100,000, can be employed. When the viscosity-average molecular weight is within the above range, suitable viscosity of the coating liquid can be obtained and the desired thickness of the coating layer can be easily formed. Thus formed coated layer has satisfactory mechanical strength so as to obtain good anti-abrasion ability. Different kind of polycarbonate resin may be mixed or copolymerized to the foregoing resin as long as the action and effects of the foregoing copolymerized carbonate resin are not disturbed.

Concrete compounds represented by Formula I, II or III are described in Paragraphs [0029] to [0034] of Japanese Patent No. 3250368 but the compounds are not limited to them.

The thickness of the charge transfer layer is preferably controlled to from 5 to 15 μm, more preferably from 6 to 13 μm. The thickness of the charge transfer layer can be measured by an eddy electric current type layer thickness measuring apparatus EDDY 560C manufactured by Helmut Fischer GMBTE Co., Ltd.

A layer of various kinds of resin can be provided as the protective layer of the photosensitive layer. Particularly, the organic photoreceptor having high mechanical strength can be obtained by the provision of a resin layer of a crosslinked type resin.

The image forming apparatus to be used in the invention is described below.

As an example of the image forming apparatus preferably used, a cleanerless type electrophotographic image forming apparatus is displayed in FIG. 1. The image forming apparatus shown in FIG. 1 is a cleanerless type electrophotographic image forming apparatus having a contact type charging device, an image carrier, a developing device and an intermediate transfer member, which has individual image carrier 1*y*, 1*m*, 1*c* and 1*k* each forming a yellow, magenta, cyan and black toner image, respectively. As the image carriers, the foregoing organic photoreceptor is preferably employed.

The image carriers 1*y*, 1*m*, 1*c* and 1*k* are each uniformly charged by respective charging devices 2*y*, 2*m*, 2*c* and 2*k* and then electrostatic images are formed on the surface thereof by modulated laser beams Ly, Lm, Lc and Lk. The electrostatic images each formed on the surface of each of the image carriers 1*y*, 1*m*, 1*c* and 1*k* are developed by developing devices 3*y*, 3*m*, 3*c* and 3*k*. The developed toner images are transferred two by two onto primary transfer rollers 4*ym* and 4*ck*. The toner images transferred by the primary transfer are transferred onto a secondary transfer roller 5. The toner images transferred to the secondary transfer roller 5 are collectively transferred onto a recording sheet 7 by a tertiary transfer roller 6. The primary, secondary and tertiary transfer rollers are applied with positive bias from a power source, not shown in the drawing, so as to electrostatically transfer the negatively charged toner.

In the image forming apparatus shown in FIG. 1, a cleaning process is substantially not necessary because the toner remaining on the image carriers 1*y*, 1*m*, 1*c* and 1*k* is substantially removed by raising the transferring efficiency as higher as possible. As a result of that, the toner scraped by scraper 8 and received by BTR unit 9 is substantially reduced or disappears so that the problem of waste toner can be dissolved.

Figure 2:
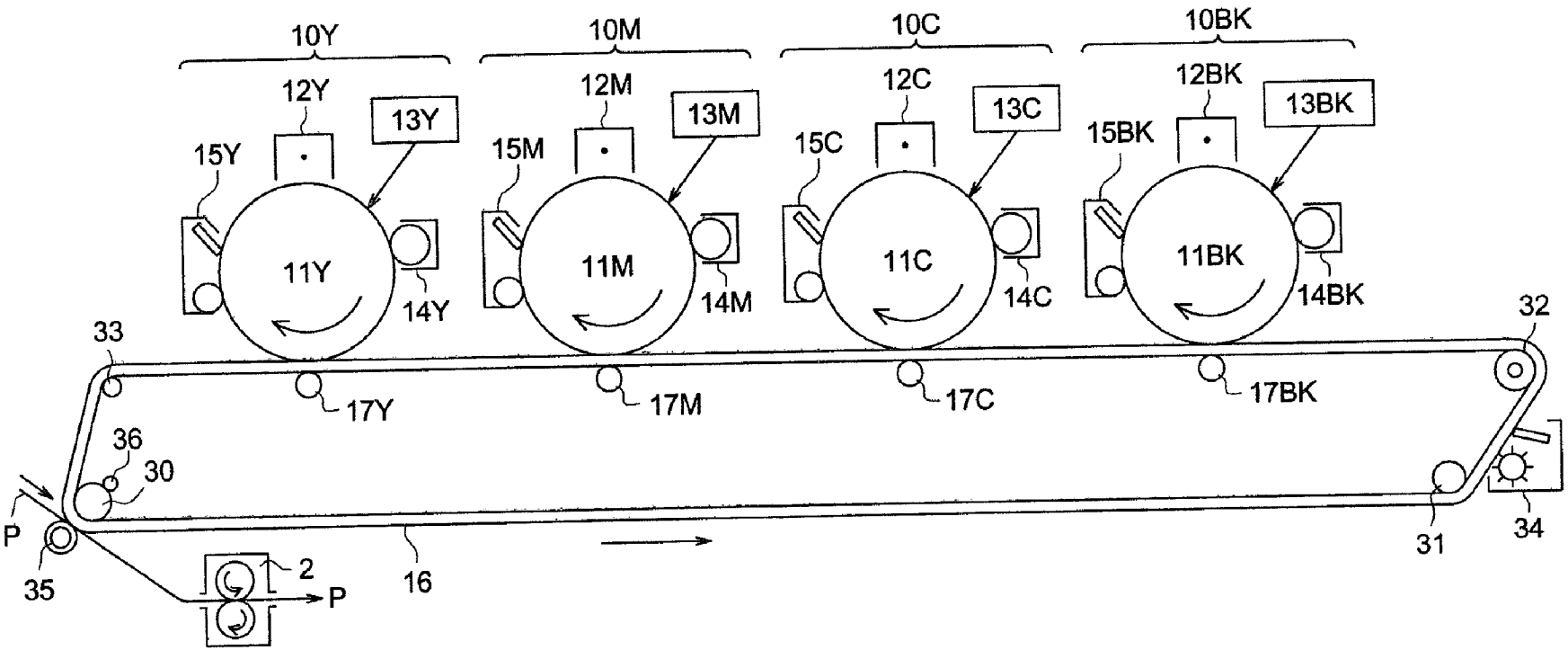
FIG. 2 shows a schematic drawing of an example of image forming apparatus having an intermediate transfer belt employed in the invention.

An intermediate transfer belt type tandem color image forming apparatus is displayed in FIG. 2. The image forming apparatus shown in FIG. 2 can be employed as a copying machine and a laser printer. The image forming apparatus shown in FIG. 2 has units 10Y, 10M, 10C and 10Bk, a belt-shaped intermediate transfer member 16, transfer rollers 17Y, 17M, 17C and 17Bk and a fixing device 2. In FIG. 2, polyimide resin is employed as the material of the belt shaped intermediate transfer member 16. However, the material of the intermediate transfer member is not always necessary to be polyimide resin when the polyimide resin is employed for a part of fixing parts of the fixing device 2 nipping the recording paper. It is preferable that both of the intermediate transfer member and the fixing parts are constituted by the polyimide resin. The polyimide resin is described later.

Photoreceptor drums 11Y, 11M, 11C and 11Bk (a flange is fixed to each of the photoreceptor drums though it is not shown in the drawing) are respectively provided in the units 10Y, 10M, 10C and 10Bk so that the photoreceptor drums can be clockwise rotated as shown by the arrow in the drawing at a designated circumference speed or processing speed. Scorotron charging devices 12Y, 12M, 12C and 12Bk, exposing devices 13Y, 13M, 13C and 13Bk, a yellow developing device 14Y, a magenta developing device 14M, a cyan developing device 14C and a black developing device 14Bk, and photoreceptor cleaners 15Y, 15M, 15C and 15Bk are each arranged around the photoreceptor drums 11Y, 11M, 11C and 11Bk, respectively.

The units 10Y, 10M, 10C and 10Bk are arranged in parallel to the intermediate transfer belt 16, and the units can be set in optional order for fitting the image forming method.

The intermediate transfer belt 16 can be rotated in anti-clockwise direction as shown by the arrow in the drawing in a circumference speed the same as that of photoreceptor drums 11Y, 11M, 11C and 11Bk by a backup roller 30 and support rollers 31, 32 and 33. The intermediate transfer roller 16 is arranged so that a part of it is touched with the photoreceptor drums 11Y, 11M, 11C and 11Bk at portions between the supporting roller 32 and 33. The belt cleaning device 34 is attached to the intermediate transfer belt 16. The supporting roller 31 filling the role of tension roller is positioned so as to be moved in the direction of the intermediate transfer belt, by which the tension of the intermediate roller can be controlled.

Transfer rollers 17Y, 17M, 17C and 17Bk are arranged inside of the intermediate transfer belt 16 and positioned so as to face to the portions where the intermediate transfer belt is contacted to the photoreceptor drums 11Y, 11M, 11C and 11Bk and form the primary transfer portions (nipping portions).

A bias roller 35 arranged on the surface side, on which the toner image is carried, of the intermediate transfer belt 16 so as to face to the backup roller 30 through the intermediate transfer belt 16. The secondary transfer portion (nipping portion) is formed by the bias roller 35 and the backup roller 30 through the intermediate transfer belt 16. The backup roller 30 has an electrode roller 36 which is rotated by contacting with the backup roller 30.

A fixing device 2 is arranged so that the recording sheet P is introduced after passing through the secondary transfer portion.

In the unit 10Y of the image forming apparatus shown in FIG. 2, the photoreceptor drum 11Y is rotated by driving. The scorotron charging device 12 is synchronously driven with the rotation of the photoreceptor drum and the surface of the photoreceptor drum 11Y is uniformly charged at a designated polarity and potential. The photoreceptor drum 11Y uniformly charged on the surface thereof is imagewise exposed by the exposure device 13Y to form an electrostatic image.

Then the electrostatic image is developed by the yellow developer 14Y and a toner image is formed on the surface of the photoreceptor drum 11Y.

The toner image is primarily transferred to the exterior surface of the intermediate transfer belt 16 by the electric field formed by transfer bias applied by the transfer roller 17Y at the time of passing the primary transfer portion (nipping portion) of the photoreceptor drum 11Y and the intermediate transfer belt 16.

The toner remaining on the photoreceptor drum 11Y is cleaned and removed by the photoreceptor cleaner 15Y. Then the photoreceptor drum 11Y is subjected to next transferring cycle.

The above transferring cycle is repeated in the units 10M, 10 and 10Bk and the second color toner image, the third color image and the fourth color image are successively formed and piled on the intermediate transfer belt 16 to form a full color toner image.

The full color toner image transferred on the intermediate transfer belt 16 is arrived at the secondary transfer portion (nipping portion), where the bias roller 35 is positioned, according to the rotation of the intermediate transfer belt 16.

The recording sheet P is supplied with designated timing between the intermediate transfer roller 16 and the bias roller 35 at the secondary transfer portion. The toner image carried on the intermediate transfer belt 16 is transferred onto the recording sheet P by pressing and conveying by the bias roller 35 and the backup roller 30 and the rotation of the intermediate transfer belt 16.

The recording sheet P, on which the toner image is transferred, is conveyed to the fixing device 2 and the toner image is fixed by pressing/heating treatment. The intermediate transfer belt is subjected to remaining toner removal after the completion of transfer by the belt cleaning device 34 and then prepared to next transfer.

For the raw material of the intermediate transfer belt and the endless belt of the fixing device of the image forming apparatus, a polyimide rein is preferably employed.

Figure 3:
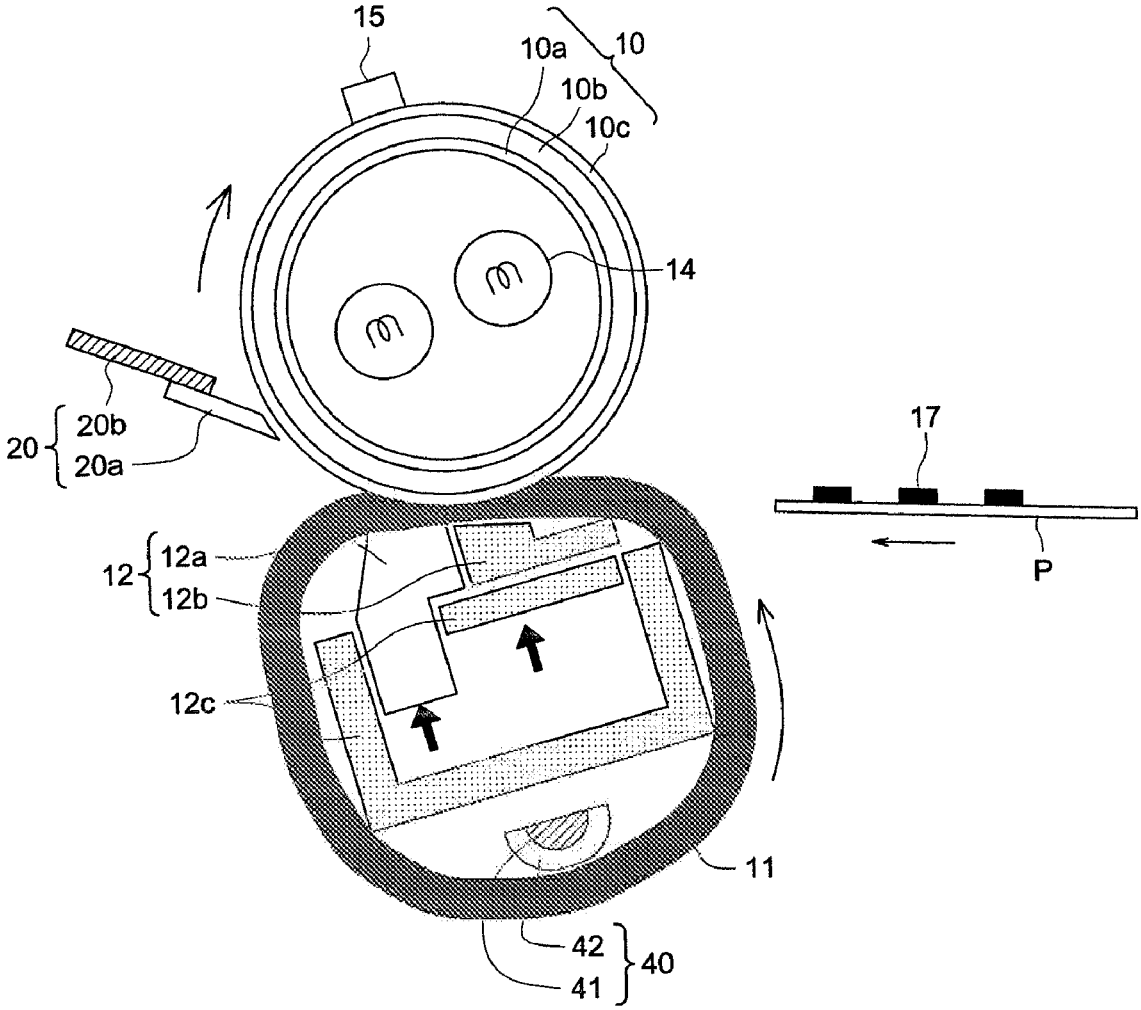
FIG. 3 shows a cross section of a side of an example of fixing device employed in the invention.

The preferably employed fixing device 2 is described below. Hereinafter, the heat fixing roller is simply referred to as the fixing roller. The fixing device 2 (FIG. 3) installed in the image forming apparatus in FIG. 2 is described. FIG. 3 displays a cross section of constitution of an example of fixing device.

In FIG. 3, the principal part is constituted by a fixing roller 10, an endless belt 11, a pressing pad (pressing member) 12*a* pressed to the fixing roller 10 through the endless belt 11, a pressing pad (pressing member) 12*b* and a lubricant supplying means 40.

The fixing roller 10 is constituted by a metal core (cylindrical metal core) 10*a*, a heat resistive elastic layer 10*b* and parting layer (heat resistive resin layer) 10*c* provided around the metal core, and a halogen lamp 14 as a heat source is arranged in the interior of the metal core 10*a*. The surface temperature of the fixing roller 10 is measured by a thermal sensor 15, and the measured signal is feed-backed to the halogen lamp 15 through a temperature controller, not shown in the drawing, so that the surface temperature is controlled at a designated value. The endless belt 11 is rounded to the fixing roller so at to make a designated angle for forming a nipping portion.

The pressing pad 12 having a low frictional surface is arranged inside of the endless belt 11 in at state of pressed to the fixing roller 10. In the pressing pad, a pressing pad 12*a* pressed by strong pressure and a passing pad 12*b* pressed by weak pressure are provided and held by a metal holder 12*c*.

A belt running guide is attached to the holder 12*c* so that the endless belt can be smoothly slid and rotated. The belt running guide is desirably a member having low frictional coefficient since the guide is slid with the interior of the endless belt, and a member having low heat conductivity is suitable so as to difficultly take heat from the endless belt 11.

The fixing roller 10 is rotated in the direction of the arrow by a motor, not shown in the drawing, and the endless belt 11 is also rotated according to the motion of the fixing roller. The toner image 17 is transferred onto the recording sheet P by a transferring device, not shown in the drawing, and the recording sheet P is conveyed to the nipping portion (in the direction of the arrow A) from the right side of the drawing. The toner image 17 on the recording sheet P is fixed by pressure applied to the nipping portion and heat giving through the fixing roller 10. When the fixing is performed by the device having the constitution shown in FIG. 1, stable fixing performance can be obtained since the nipping portion is made wide.

After the fixing, the recording medium P is suitably separated without twining from the fixing roller by the effects of the parting layer 10*c* and the distortion at the nipping portion, however, it is desirable that a peeling means 20 is provided at a downstream position in the rotating direction of the fixing roller of the nipping portion as a separation aiding means. The peeling means 20 is held by a guide 20*b* so that a peeling sheet

20*a* is contacted with the fixing roller 10 in the direction of in the reverse direction to the rotating direction of the fixing roller 10.

The constitution of each of the parts is described below. For the core 10*a*, a cylindrical pipe of a metal having high heat conductance such as iron, aluminum and stainless steel can be employed. The external diameter and the thickness of the core 10*a* in the fixing device employed in the invention may be small since the pressure by the pressing pad 12 is small, in concrete one having an external diameter of from 20 to 35 mm and a thickness of from 0.3 to 0.5 mm can be employed in the case of an iron core. Of course, the size of the core may be suitably decided since the strength and the heat conductance are varied according to the material to be employed.

Any material can be employed for the heat resistive elastomer layer 10*b* as long as the materials are an elastomer having high heat resistivity. Particularly, an elastic substance such as rubber and elastomer having a rubber hardness of about from 25 to 40° (JIS-A) is preferable, in concrete, silicone rubber and fluorinated rubber are usable. The heat resistive elastic layer 10*b* is preferably about 0.3 to 1.0 mm even though the thickness is varied depending on the rube hardness of the material.

In the fixing device, the total loading by the pressing pad 12 can be made small and the thickness of the heat resistive elastic layer 10*b* can be made thin since the sufficient fixation can be obtained by the large nipping width and the separation can be effectively performed by small distortion. As above-mentioned, the external diameter and the thickness of the core 10*a* of the fixing device can be made small and the thickness of the heat resistive elastic layer 10*b* is also made thin. Therefore, the instant starting ability is improved and/or the output of the halogen lamp 14 as the heat source can be lowered since the heat capacity of the fixing device is extremely lower that that of a usual roller pear type fixing device. Moreover, the heat resistance between the interior and the external surface of the fixing roller 10 can be lowered so that the thermal. response can be raised. Accordingly, the electric power consumption can be reduced and rapid fixation can be made possible.

For the parting layer (heat resistive resin layer) 10*c* to be formed on the heat resistive elastic layer 10*b*, any resin may be employed as long as those are a heat resistive resin, for example, a fluororesin and a silicone resin. The use of the fluororesin is particularly preferable considering the parting ability and the anti-abrasion ability. A fluororesin such as PFA (perfluoroalkyl vinyl ether copolymer resin), PTFE (polytetrafluoroethylene) and FEP (tetrafluoroethylene-hexafluoropropylene copolymer resin) is employable, and PFA is the most suitable from the viewpoint of the heat resistivity and the suitability for producing. The thickness of the parting layer 10*c* is preferably from 5 to 30 μm, and more preferably from 10 to 20 μm. When the thickness of the parting layer is less than 5 μm, a probability is posed that winkles are caused by distortion of the fixing roller 10. When the thickness exceeds 30 μm, the parting layer becomes hard and a probability is posed that an image defect such as the unevenness in glossiness caused. Both of the cases are undesirable. Any known methods can be applied for forming the parting layer 10*c*, for example, a dipping coating method, a spray coating method, a roller coating method and a spin coating method are applicable.

The endless belt is preferably constituted by a base layer and a parting layer covering the surface (the surface contacting with the fixing roller 10 or both of the surfaces) of the base layer. The base layer is selected from polyimide, polyamide and polyamideimide and the thickness of the layer is preferably about from 50 to 125 μm, and more preferably about from 75 to 100 μm. The parting layer to be formed on the surface of the base layer is preferably formed by coating the foregoing fluororesin such as PFA in a thickness of from 5 to 20 μm.

The winding angle of the endless belt 11 with the fixing roller 10 is preferably about from 20° to 45° so as to take sufficient width of the nipping portion even though the angle may be varied depending on the rotation rate of the fixing roller. It is preferable that the winding angle is adjusted so that the duel time (passing time of the recording medium) in the nipping is not less than 30 msec, particularly from 50 to 70 msec. The width of the nipping portion can be made wide and the fixing ability and the parting ability of the toner can be improved by the use of the endless belt capable of following the shape of the fixing roller 10.

In the basic constitution of the pressing pad 12, the pressing pad 12*a* with low pressure is arranged at the entrance side and the pressing pad with the high pressure is arranged at the exit side of the nipping portion for holding the wide nipping portion. A low frictional layer is provided on the surfaces of the pressing pad 12*a* and 12*b* which are contacted with the endless belt 12 for reducing the frictional resistance between the interior surface of the endless belt and the pressing pad 12. The raw material of the nipping member 12*b* is the same as that of 12*b*.

It is allowed to supply a lubricant between the surface of the pressing pad 12 and the inside surface of the endless belt 11. For example, silicone oil, fluorinated oil and grease are usable. Though the lubricant is coated by the inside of the belt, there is probability that the lubricant comes into inside the endless belt and adheres to the fixing roller. Therefore, the lubricant is preferably one having parting ability. The silicone oil is preferable than the fluorinated oil when the problem on the safeness is considered.

Examples of the silicone oil include dimethyl silicone oil, an amino-modified silicone oil, a carboxyl-modified silicone oil, a silanol-modified silicone oil, and a sulfonic acid-modified silicone oil. Among them, the amino-modified silicone oil having a viscosity of from 500 to 10,000 cp is preferable which is excellent in the handling suitability and by which the starting torque and the driving torque of the image fixing device can be maintained in a desired low range. Though the lubricant is not consumed, it is gradually decreased and finally run out sometimes since the lubricant comes into the inside of the belt in a long period and the torque is increased. Accordingly, in the invention, the fixing device has a lubricant supplying means 40 for holding and supplying the lubricant corresponding to the life of the fixing device so that the lubricant is not run out.

A lubricant holding member 41 of the lubricant supplying means 40 is preferably one having many continuous pores and heat resistivity and suitable elastic modulus at the fixing temperature such as felt and sponge. A lubricant permeation amount regulating membrane 42 is preferably one having many continuous pores, heat resistivity at the fixing temperature and a low frictional coefficient such as one formed by expanding a resin having the heat resistivity and the low frictional coefficient is preferable. Film formed by expanding a fluororesin is suitable.

The lubricant holding member 41 is impregnated with the lubricant, and the lubricant permeation amount regulating member 42 of the lubricant supplying means 40 is contacted with almost entire range of the axis direction of the endless belt, and supplies the lubricant to entire interior surface of the endless belt 11 accompanied with the rotation of the endless belt 11. It is not necessary to supply a large amount of the lubricant. Therefore, the contacting pressure of the lubricant supplying means 40 to the endless belt is preferably small so that the lubricant supplying means 40 is slightly contacted with the endless belt 11.

It is important that the very small amount of the lubricant is continuously supplied onto the interior surface of the endless belt 11. The amount of the lubricant to be supplied to the interior surface of the endless belt 11 can be regulated by the permeating amount of the lubricant through the lubricant permeation amount regulating member 42 by varying the pore ratio in the porous lubricant permeation amount regulating member 42.

It is desirable in the lubricant supplying means 40 that the supplying amount at the central portion in the axis direction of the endless belt 11 is larger than that near the both edges of the endless belt. Such the situation can be formed by making wider the contacting width of the lubricant supplying means 40 near the central portion of the endless belt 11 than that near the edge portion or making stronger the contacting pressure of the lubricant supplying means 40 near the central portion of the endless belt 11 than that near the edge portion. The supplying amount is increased by making wider the contacting width of the lubricant supplying means 40 at the central portion than that at the edge portion. The distribution of the lubricant supplying amount effects on the occurrence of the winkles on the occasion of the rotation of the endless belt 11. When the speed of the central portion of the belt is larger than that at the edge portion, no winkle occurs on the belt. However, the winkles tend to occur when the speed of the belt at the central portion is lower than that at the edge portion. Therefore, the supplying amount of the lubricant is increased at the central portion of the belt so that the central portion of the belt is easily run for preventing the occurrence of the winkles.

The lubricant supplying means 40 is attached on the outer surface of the belt running guide and weakly touched to the inner face of the endless belt 11. The lubricant supplying means 40 is arranged near the entrance of the nipping portion. At the entrance side of the nipping portion, force for pushing the belt to the running guide is caused by the rotation of the endless belt 11. Accordingly, the belt can be pressed without deviation by providing the lubricant supplying means at this position.

The polyimide resin has a characteristic that the deformation of the belt on the occasion of the driving is small compared with usually employed thermoplastic resins.

As the material for such the belt, a poly(pyromellitic acid imide) type imide resin such as KAPTON HA, manufactured by Du Pont Co., Ltd., a poly(biphenyltetracaroxylic acid imide) type resin such as Iupilex, manufactured by Ube Kosan Co., Ltd., and a poly(benzotetracarboxylic acid)imide type resin such as Iupolex R, manufactured by Ube Kosan Co., Ltd., and LARC-TPI (thermoplastic polyimide resin), manufactured by Mitsui Toatsu Kagaku Kogyo Co., Ltd. can be cited. These reins have each a Young's modulus of not less than 3430 N/mm$^2$, and they satisfy the mechanical properties as the base material of the belt at a thickness of from 70 μm to 100 μm.

The polyimide resin is generally a polymer synthesized by condensation polymerization of a tetracarboxylic acid dianhydride and a diamine or a di-isocyanate as monomer components. Examples of the anhydride of tetracarboxylic acid component include pyromellitic acid, naphthalene-1,4,5,8-teracarboxylic acid; naphthalene-2,3,6,7-tetracarboxylic acid, 2,3,5,6-biphenyltetracarboxylic acid, 2,2',3,3'-biphenyltetracarboxylic acid, 3,3',4,4'-biphenyl-tetracarboxylic acid, 3,3',4,4'-diphenyl ether tetracarboxylic acid, 3,3',4,4'-benzophenonetetracarboxylic acid, 3,3',4,4'-diphenylsulfontetracarboxylic acid, 3,3',4,4'-azobenzeneteracarboxylic acid, bis(2,3-dicarboxyphenyl)methane, bis(3,4-dicarboxyl) methane, β,β-bis(3,4-dicarboxyphenyl)propane and β,β-bis (3,4-dicarboxyphenyl)hexafluoropropane.

Examples of the diamine component include m-phenyldiamine, p-phenyldiamine, 2,4-diaminotoluene, 2,6-diaminotoluene, 2,6-diaminotoluene, 2,4-diaminochlorobenzene, m-xylenediamine, p-xylenediamine, 1,4-diaminonaphthalene, 1,5-diaminonaphthalene, 2,6-diaminonaphthalene, 2,4'-diaminonaphthalenobiphenyl, benzidine, 3,3-dimethylbenzidine, 3,3'-dimethoxybenzidine, 3,4'-diaminodiphenyl ether, 4,4'-diaminodiphenyl ether (oxy-p,p'-dianiline; ODA), 4,4'-diaminodiphenyl sulfide, 3,3'-diaminobenzophenone, 4,4'-diaminophenylsulfon, 4,4'-diaminobenzene, 4,4'-diaminodiphenylmethane, and β,β-bis(4-aminophenyl) propane. As the di-isocyanate component, the above-listed compounds in which the amino group is replaced by an isocyanate group are employable. Examples of the commercial product of the polyimide include a pyromellitic acid type polyimide containing ODA as the diamine component, KAPTON manufactured by Du Pont Co., Ltd., and 3,3',4,4'-biphenylteracarboxylic acid type polyimide, Iupilex S, manufactured by Ube Kosan Co., Ltd.

The polyimide resin may be one satisfying the relation expression of the Young's modulus and the deviation of the belt caused by the loading on the occasion of driving described in Japanese Patent Tokkai 2000-338778 and one having the contact angle with water and the mechanical property of surface resistivity described in Japanese Patent Tokkai Hei 11-231684. Namely, it may be a polyimide resin composition in which an electroconductive inorganic fine powder and/or a fine powder of resin having low surface energy are dispersed.

As the electroconductive agent to be dispersed in the base material, fine powder of one or more kinds of the followings are employable; a carbon type electroconductive material such as carbon black and graphite, a metal such as aluminum and copper or an alloy thereof, an electroconductive metal oxide such as a tin oxide, zinc oxide, antimony oxide, indium oxide, potassium titanate, a composite oxide of antimony oxide and tin oxide (ATO) and a composite oxide of indium oxide and tin oxide (ITO), an electrolyte such as lithium perchlorate, a quaternary ammonium perchlorate, a quaternary ammonium chloride and sodium trifluoromethanesulfonate. The above metal oxides are preferably treated on the surface by one or more kinds of silane coupling agent. The surface treated metal oxide can be uniformly dispersed, which inhibits the scattering in the resistivity of the base material since the miscibility of the metal oxide with the resin constituting the base material is improved. An insulator fine particle such as barium sulfate, calcium carbonate and magnesium silicate covered with the electroconductive metal oxide can be also employable. The average particle diameter of the electroconductive agent is preferably not more than 1 μm. The adding amount of the electroconductive agent is preferably from 10 to 30% by weight. As the material constituting the resin particle having low surface energy, a fluororesin polymer can be cited, for example, PTFE (polytetrafluoroethylene), PFA (tetrafluoroethylene-perfluoroalkyl vinyl ether copolymer), FEP (tetrafluoroethylene-hexafluoropropylene copolymer), EPE (tetrafluoroethylene-hexafluoropropylene-perfluoroalkyl vinyl ether copolymer), ETFE (tetrafluoroethylene-ethylene copolymer), PCTFE (polychlorotrifluoroethylene), ECTFE (chlorotrifluoroethylen-ethylene copolymer), PVDF (poly(vinylidene fluoride)) and PVF (poly(vinyl fluoride)). Examples of the fluorinated rubber include vinylidene fluoride-trifluoroethylene copolymer, vinylidene-hexafluoropropylene copolymer and vinylidene fluoride-hexafluoropropylene-tetrafluoropropylene three-component copolymer. The average particle diameter of the fine powder having low surface energy is preferably within the range of from 0.1 μm to 1 μm, and the adding amount of which is preferably within the range of from 3 to 15% by weight.

It is preferable that the contact angle of water drop on the surface of parts made of the polyimide resin is not less than 100° and that on the backside surface is less than 90° and the Young's modulus the resin is not less than 30,000 kg/cm$^2$.

The surface conductance of the intermediate transfer member is preferably within the range of from $10^{10}$ Ω/□ to less than $10^{14}$ Ω/□. It is particularly preferable to be within the range of from $10^{10.5}$ Ω/□ to $10^{12}$ Ω/□. The surface resistance can be easily adjusted according to the selection and adding amount of the electroconductive agent. When the surface resistance is less than $10^{10}$ Ω/□, the graininess of image is degraded sometimes since the electric field is strengthen and gap discharge tens to occur in the nipping portion. When the surface resistance exceeds $10^{14}$ Ω/□, a blank falling of image, so called as discharge image falling, occurs as a result of peeling discharge at the post-nipping portion where the image carrier and the intermediate transfer belt are separated. Moreover, the volume resistance of the intermediate transfer belt is preferably within the range of from $10^8$ to $10^{13}$ Ω·cm. The contact angle with water drop can be measured by the method described in Japanese Patent Tokkai Hei 11-231684.

For obtaining good transfer image quality, the thickness of the intermediate transfer belt is preferably not less than 50 μm. When the intermediate belt is too thick, the deformation of the belt surface at the tension roller becomes large, and disagreement of piled images is caused by slipping out of the positions of color images. Therefore, the thickness is preferably within the range of from 50 to 150 μm, and particularly from 70 to 100 μm.

EXAMPLES

The invention is described in detail below, but the invention is not limited to the embodiments of the examples.

Example 1

Preparation of Toner

<<Toner C-1>>

(Preparation of Resin Particle Dispersion)

Preparation of Resin Particle

In a flask attached with a stirring device, 162.0 g of parting agent composed of 88 parts by weight of stearyl stearate, 6 parts by weight of behenyl stearate, 3 parts by weight of stearyl behenate, and 3 parts by weight behenyl behenate were added to the following composition and dissolved by heating at 75° C. The solution was referred to as Polymerizable Monomer Solution 1-1.

| | |
|---|---|
| Styrene | 172.9 g |
| n-butyl acrylate | 55.0 g |
| Methacrylic acid | 23.1 g |

Besides, in a 5,000 ml separable flask, to which a stirring device, a thermal sensor and a cooling tube were attached, 2.5 g of anionic surfactant 101 ($C_{12}H_{25}(OCH_2CH_2)_2OSO_3Na$) was dissolved in 1340 g of deionized water to prepare a surfactant solution. The surfactant solution was heated by 80° C. and Polymerizable Monomer Solution 1-1 was mixed and dispersed for 2 hours in the surfactant solution by a mechanical dispersing machine having a circulation pass. CLEARMIX manufactured by M•Technique Co., Ltd., to prepare an emulsion (suspension) containing emulsified particles (oil droplets) having a diameter of 482 nm.

Thereafter, 1460 ml of deionized water was added and then an initiator solution of 7.5 g a polymerization initiator (potassium persulfate: KPS) dissolved in 142 ml of deionized water and. 6.47 g of n-octanethiol were further added. Polymerization (the first step polymerization) was performed by heating and stirring the system at 80° C. for 3 hours. Thus resin particles (dispersion of polymer particles) were obtained, which was referred to as Resin Particle 1-1.

To the dispersion, an initiator solution of 11.6 g of initiator KPS dissolved in 220 ml of deionized water was added and then the following Polymerizable Monomer solution 1-2 was dropped spending for 1 hour under a temperature condition of 80° C., (Polymerizable Monomer Solution 1-2)

| | |
|---|---|
| Styrene | 291.2 g |
| n-butyl acrylate | 132.2 g |
| Methacrylic acid | 42.9 g |
| n-octanethiol | 7.51 g |

After completion of the dropping, polymerization (the second step of polymerization) was carried out by heating and stirred for 2 hours and then cooled by 28° C. to obtain a dispersion of resin particle 1-2 using the resin particle 1-1 as the raw material.

(Preparation of Colorant Dispersion)

To a solution of 59.0 g of Surfactant 101 dissolved in 1,600 ml of deionized water, 280.0 g of C. I. Pigment Blue 15:1 was gradually added while stirring the solution and then dispersed by CLEARMIX, manufactured by M•Technique Co., Ltd., to prepare a dispersion of the colorant. The particle diameter of the colorant dispersion was 93 nm. The dispersion was referred to as Colorant Dispersion c-1.

(Association Process)

In a four-mouth flask attached with a thermal sensor, a cooler, a nitrogen gas introducing device and a stirring device, 259.3 g (in terms of solid component) of Resin particle 1-2 for inner layer, 1,120 ml of deionized water and 237 g of the above colorant dispersion were charged and stirred. After adjusting the interior temperature of the flask at 30° C., a 5 moles/liter aqueous solution of sodium hydroxide was added to adjust the pH value to 10.

Then 20.1 g of a 10 weight-% solution of poly(aluminum chloride) was added spending for 10 minutes while stirring at 30° C. After standing for 3 minutes, heating of the system was begun and the temperature was raised by 90° C. spending for 60 minutes for performing the association of the resin particle 1-2 and the colorant particles.

The particle diameter of the colored particle ml for forming the inner layer was measured by COULTER COUNTER TA-II, manufactured by Beckman Coulter Co., Ltd., while stirring and heating, and a solution of 15.3 g of sodium chloride dissolved in 100 ml of deionized water was added at a time when the volume diameter (Dv50) become to 4.5 μm to inhibit the growing of the particle.

The stirring and heating were further continued for 1 hour or more and the later-described resin particle dispersion for outer layer S-1 was separately added for four times by one fourth amount when the circular degree become to 0.944 so that the resin particles s1 for outer layer were fused. Thus a dispersion of toner particles C-1 was obtained. The circular degree after the final addition of the resin particle s1 for outer layer was 0.956.

(Preparation of Resin Particle for Outer Layer S-1)

| | |
|---|---|
| Styrene | 322.3 g |
| n-butyl acrylate | 121.9 g |
| Methacrylic acid | 35.5 g |

In a 5,000 ml separable flask attached with a stirring device, thermal sensor and cooling tube, 2.5 g of the surfactant 101 was dissolved in 1340 g of deionized water to form a surfactant solution. The above surfactant solution was heated by 80° C., and the above polymerizable monomer solution was dispersed for 2 hours in the surfactant solution by the mechanical dispersing machine CLEARMIX, manufactured by M•Technique Co., Ltd., having a circulating pass to prepare an emulsion (dispersion) containing emulsified particles (oil droplets) having a diameter for 182 nm.

Thereafter, 1460 ml of deionized water was added and then an initiator solution of 7.5 g of polymerization initiator (potassium persulfate: KPS) dissolved in 142 ml of deionized water and 6.6 g of n-octanethiol were added, and then polymerization was performed by heating and stirring the system for 3 hours at 80° C. to obtain resin particles (a dispersion of low molecular weight resin particles).

(Solid-Liquid Separation, Drying Process)

The dispersion of Toner Particle C-1 was subjected to centrifugal dehydration and washed while pouring deionized water of 40° C. and then dried by air heated at 40° C. Thus Toner Particle C-1 was obtained.

(External Additive Mixing Process)

To the above Toner Particle C-1, 0.8 parts by weight of hydrophobic silica having a primary particle diameter of 14 nm, 1.0 part by weight of needle-shaped hydrophobic titanium oxide, 1.0 part by weight of hydrophobic silica having a primary particle diameter of 85 nm, 1.0 part by weight of hydrophobic silica having a primary particle diameter of 140 nm, 0.11 parts by weight of zinc oleate, 0.05 parts by weight of zinc palmitate, 0.07 parts by weight of zinc stearate and 0.03 parts by weight of zinc myristate were added and mixed for 5 minutes by a HENSCHEL-MIXER at a circumference speed of the rotating wings of 30 m/sec. By the above processing, Toner C-1 can be prepared from Toner Particle C-1. The average value of the circular degree of the toner particles, the volume diameter (Dv50) of the toner, the temperature of the endothermic peak and the amount of endothermic heat were measured by DSC, and the kinds of the metal soap are listed in Tables 1-1, 1-2 and 2.

<<Toner M-1>>

Toner M-1 was obtained in the same manner as in the preparation of colorant dispersion of Toner C-1 except that 420 g of C. I. Pigment Red 184 was employed in place of 280.0 g of C. I. Pigment Blue 15:1.

<<Toner Y-1>>

Toner Y-1 was obtained in the same manner as in the preparation of colorant dispersion of Toner C-1 except that 420 g of C. I. Pigment Yellow 74 was employed in place of 280.0 g of C. I. Pigment Blue 15:1.

<<Toner Bk-1>>

Toner Bk-1 was obtained in the same manner as in the preparation of colorant dispersion of Toner C-1 except that 420 g of neutral carbon black REGAL 660, manufactured by Cabot Co., Ltd., was employed in place of 280.0 g of C. I. Pigment Blue 15:1.

<<Toner C-2>>

Toner C-2 was obtained in the same manner as in Toner C-1 except that the total amount of the parting agents was 102 g and the combining ratio thereof was varied as shown in Table 1, and the sodium chloride solution was added at a time when the volume diameter (Dv50) become to 4.5 μm, and the sodium chloride was added at a time when the volume diameter (Dv50) become to 5.5 μm, and the resin particles dispersion for outer layer S-1 was added at a time when the circular degree become to 0.944 and the resin particles dispersion for outer layer S-1 was added at a time when the circular degree become to 0.963.

<<Toner M-2>>

Toner M-2 was obtained in the same manner as in Toner C-1 except that 380 g of the following Compound A and 40 g of the following Compound B were employed as magenta pigments in place of 28.0 g of C. I. Pigment Blue 15:1.

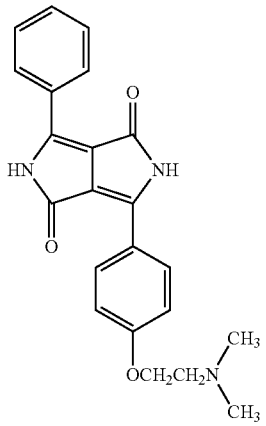

Compound A

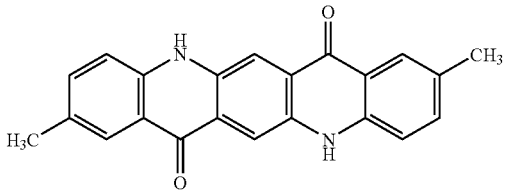

<<Toner Y-2>>

Toner Y-2 was obtained in the same manner as in the preparation of colorant dispersion of Toner C-2 except that 420 g of the following Compound C was employed as yellow pigment in place of 280.0 g of C. I. Pigment Blue 15:1.

Compound C

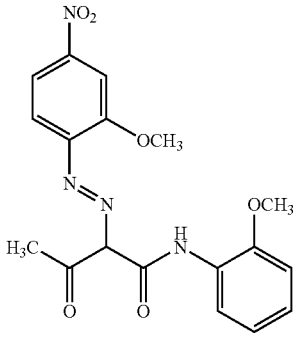

<<Toner Bk-2>>

Toner Bk-2 was obtained in the same manner as in the preparation of colorant dispersion of Toner C-2 except that 420 g of neutral carbon black REGAL 660, manufactured by Cabot Co., Ltd., was employed in place of 280.0 g of C. I. Pigment Blue 15:1.

<<Toners C-3 through Bk-3

Toners C-3 through Bk-3 were obtained in the same manner as in Toner C-1 except that the total amount of the parting agents was 145 g and the combining ratio thereof was varied as shown in Table 1, and the sodium chloride solution was added at a time when the volume diameter (Dv50) become to 4.5 μm, and the sodium chloride was added at a time when the volume diameter (Dv50) become to 3.7 μm, and the resin particles dispersion for outer layer S-1 was added at a time when the circular degree become to 0.956 and the resin particles dispersion for outer layer S-1 was added at a time when the circular degree become to 0.963.

<<Comparative Toners c-1 through bl-1>>

Comparative Toners c-1 through bk-1 were obtained in the same manner as in Toner C-1 except that the sodium chloride solution was added at a time when the volume diameter (Dv50) become to 4.5 μm, and the sodium chloride was added at a time when the volume diameter (Dv50) become to 3.2 μm, and the resin particles dispersion for outer layer S-1 was added at a time when the circular degree become to 0.956 and the resin particles dispersion for outer layer S-1 was added at a time when the circular degree become to 0.941.

<<Comparative Toners c-2 through bk-2>>

Comparative Toners c-2 through bk-2 were obtained in the same manner as in Toner C-1 except that 204.0 g of glycerol tribehenate was only employed in place of 162 g of the parting agents composed of 88 parts by weight of stearyl stearate, 6 parts by weight of behenyl stearate, 3 parts by weight of steary behenate and 3 parts by weight of behenyl behenate.

<<Comparative Toners c-3 through bk-3>>

Comparative Toners c-3 through bk-3 were obtained in the same manner as in Toner C-1 except that no metal soap was added.

TABLE 1

| Name of toner | Circular degree of completed toner | Volume diameter (Dv50) (μm) | Parting agent 1 (parts by weight) | Parting agent 2 (parts by weight) | Parting agent 3 (parts by weight) | Parting agent 4 (parts by weight) |
|---|---|---|---|---|---|---|
| Toner C-1 | 0.956 | 4.7 | Stearyl stearate (88) | Behenyl stearate (6) | Stearyl behenate (3) | Behenyl behenate (3) |
| Toner M-1 | 0.956 | 4.7 | Stearyl stearate (88) | Behenyl stearate (6) | Stearyl behenate (3) | Behenyl behenate (3) |
| Toner Y-1 | 0.957 | 4.7 | Stearyl stearate (88) | Behenyl stearate (6) | Stearyl behenate (3) | Behenyl behenate (3) |
| Toner Bk-1 | 0.956 | 4.8 | Stearyl stearate (88) | Behenyl stearate (6) | Stearyl behenate (3) | Behenyl behenate (3) |
| Toner C-2 | 0.975 | 5.7 | Stearyl stearate (3) | Behenyl stearate (6) | Stearyl behenate (3) | Behenyl behenate (88) |
| Toner M-2 | 0.975 | 5.7 | Stearyl stearate (3) | Behenyl stearate (6) | Stearyl behenate (3) | Behenyl behenate (88) |
| Toner Y-2 | 0.975 | 5.7 | Stearyl stearate (3) | Behenyl stearate (6) | Stearyl behenate (3) | Behenyl behenate (88) |
| Toner Bk-2 | 0.974 | 5.7 | Stearyl stearate (3) | Behenyl stearate (6) | Stearyl behenate (3) | Behenyl behenate (88) |
| Toner C-3 | 0.966 | 5.1 | Stearyl stearate (48) | Behenyl stearate (6) | Stearyl behenate (3) | Behenyl behenate (43) |
| Toner M-3 | 0.967 | 5.1 | Stearyl stearate (48) | Behenyl stearate (6) | Stearyl behenate (3) | Behenyl behenate (43) |
| Toner Y-3 | 0.967 | 5.1 | Stearyl stearate (48) | Behenyl stearate (6) | Stearyl behenate (3) | Behenyl behenate (43) |
| Toner Bk-3 | 0.966 | 5.1 | Stearyl stearate (48) | Behenyl stearate (6) | Stearyl behenate (3) | Behenyl behenate (43) |
| Comparative toner c-1 | 0.953 | 4.2 | Stearyl stearate (88) | Behenyl stearate (6) | Stearyl behenate (3) | Behenyl behenate (3) |
| Comparative toner m-1 | 0.953 | 4.2 | Stearyl stearate (88) | Behenyl stearate (6) | Stearyl behenate (3) | Behenyl behenate (3) |
| Comparative toner y-1 | 0.953 | 4.2 | Stearyl stearate (88) | Behenyl stearate (6) | Stearyl behenate (3) | Behenyl behenate (3) |
| Comparative toner bk-1 | 0.953 | 4.2 | Stearyl stearate (88) | Behenyl stearate (6) | Stearyl behenate (3) | Behenyl behenate (3) |

TABLE 1-continued

| Name of toner | Circular degree of completed toner | Volume diameter (Dv50) (μm) | Parting agent 1 (parts by weight) | Parting agent 2 (parts by weight) | Parting agent 3 (parts by weight) | Parting agent 4 (parts by weight) |
|---|---|---|---|---|---|---|
| Comparative toner c-2 | 0.956 | 4.7 | Glycerol tribehenate (100) | None | None | None |
| Comparative toner m-2 | 0.956 | 4.7 | Glycerol tribehenate (100) | None | None | None |
| Comparative y-2 | 0.957 | 4.7 | Glycerol tribehenate (100) | None | None | None |
| Comparative bk-2 | 0.956 | 4.8 | Glycerol tribehenate (100) | None | None | None |
| Comparative c-3 | 0.956 | 4.7 | Stearyl stearate (88) | Behenyl stearate (6) | Stearyl behenate (3) | Behenyl behenate (3) |
| Comparative m-3 | 0.956 | 4.7 | Stearyl stearate (88) | Behenyl stearate (6) | Stearyl behenate (3) | Behenyl behenate (3) |
| Comparative y-3 | 0.957 | 4.7 | Stearyl stearate (88) | Behenyl stearate (6) | Stearyl behenate (3) | Behenyl behenate (3) |
| Comparative bk-3 | 0.956 | 4.8 | Stearyl stearate (88) | Behenyl stearate (6) | Stearyl behenate (3) | Behenyl behenate (3) |

TABLE 2

| Name of toner | Position of the largest endothermic peak (° C.) | Heat amount at the largest endothermic peak (J/mg) | Zinc oleate (parts by weight) | Zinc palmitate (parts by weight) | Zinc stearate (parts by weight) | Zinc myristate (parts by weight) | Remarks |
|---|---|---|---|---|---|---|---|
| Toner C-1 | 61.2 | 22.6 | 0.11 | 0.05 | 0.07 | 0.03 | Inv. |
| Toner M-1 | 61.2 | 22.6 | 0.11 | 0.05 | 0.07 | 0.03 | Inv. |
| Toner Y-1 | 61.2 | 22.6 | 0.11 | 0.05 | 0.07 | 0.03 | Inv. |
| Toner Bk-1 | 61.2 | 22.5 | 0.11 | 0.05 | 0.07 | 0.03 | Inv. |
| Toner C-2 | 71.3 | 13.1 | 0.11 | 0.05 | 0.07 | 0.03 | Inv. |
| Toner M-2 | 71.3 | 13.1 | 0.11 | 0.05 | 0.07 | 0.03 | Inv. |
| Toner Y-2 | 71.3 | 13.2 | 0.11 | 0.05 | 0.07 | 0.03 | Inv. |
| Toner Bk-2 | 71.3 | 13.1 | 0.11 | 0.05 | 0.07 | 0.03 | Inv. |
| Toner C-3 | 65.7 | 18.4 | 0.11 | 0.05 | 0.07 | 0.03 | Inv. |
| Toner M-3 | 65.7 | 18.4 | 0.11 | 0.05 | 0.07 | 0.03 | Inv. |
| Toner Y-3 | 65.7 | 18.5 | 0.11 | 0.05 | 0.07 | 0.03 | Inv. |
| Toner Bk-3 | 65.7 | 18.4 | 0.11 | 0.05 | 0.07 | 0.03 | Inv. |
| Comparative toner c-1 | 61.2 | 22.6 | 0.11 | 0.05 | 0.07 | 0.03 | Comp. |
| Comparative toner m-1 | 61.2 | 22.6 | 0.11 | 0.05 | 0.07 | 0.03 | Comp. |
| Comparative toner y-1 | 61.2 | 22.6 | 0.11 | 0.05 | 0.07 | 0.03 | Comp. |
| Comparative toner bk-1 | 61.2 | 22.6 | 0.11 | 0.05 | 0.07 | 0.03 | Comp. |
| Comparative toner c-2 | 81.3 | 24.6 | 0.11 | 0.05 | 0.07 | 0.03 | Comp. |
| Comparative toner m-2 | 81.3 | 24.6 | 0.11 | 0.05 | 0.07 | 0.03 | Comp. |
| Comparative toner y-2 | 81.3 | 24.6 | 0.11 | 0.05 | 0.07 | 0.03 | Comp. |
| Comparative toner bk-2 | 81.3 | 24.6 | 0.11 | 0.05 | 0.07 | 0.03 | Comp. |
| Comparative toner c-3 | 61.2 | 22.6 | 0.11 | None | None | None | Comp. |
| Comparative toner m-3 | 61.2 | 22.6 | 0.11 | None | None | None | Comp. |
| Comparative toner y-3 | 61.2 | 22.6 | 0.11 | None | None | None | Comp. |
| Comparative toner bk-3 | 61.2 | 22.5 | 0.11 | None | None | None | Comp. |

(Preparation of Developer)

A carrier was prepared as follows. A ferrite core material having a volume diameter (Dv50) of 40 μm and the following coating layer forming solution were combined. A composition composed of 1,000 parts by weight of the ferrite core material and the following coating layer forming solution were put into a vacuum deairing type kneader, the inner wall of which was heated at 100° C, and stirred for 15 minutes and then the solvent was removed under vacuum to form a coating layer on the core particle. Thus the carrier was prepared.

| | |
|---|---|
| Toluene | 150 parts by weight |
| MMA | 24.1 parts by weight |
| Carbon black | 6.0 parts by weight |
| Crosslinked styrene fine particle of 0.3 μm | 4.0 parts by weight |
| 3,3,4,4,5,5,6,6,7,7,8,8,9,9,10,10-heptadecafluorodecyl methacrylate | 2.0 parts by weight |

The toners were each mixed with the above carrier so to make the toner concentration to 6% by weight. Thus double-component developers were prepared.

(Preparation of Photoreceptor)

Photoreceptors to be employed for the examples were prepared as follows. Four or more photoreceptors were prepared since the same kind of photoreceptor was employed in each of the image forming units.

The following intermediate layer coating liquid was prepared and coated on a cleaned cylindrical aluminum substrate by an immersion coating method to form an intermediate layer having a dry layer thickness of 0.3 μm.

<Intermediate Layer (UCL) Coating Liquid>

| | |
|---|---|
| Polyamide resin: Amilan CM-800 (Toray Co., Ltd.) | 60 g |
| Methanol | 1600 ml |

The following composition was mixed and dispersed for 10 hours by a sand mill to prepare a charge generation layer coating liquid. The coating liquid was coated by the immersion coating method to form a charge generation layer having a dry thickness of 0.2 μm on the intermediate layer.

<Charge Generation Layer (CGL) Coating Liquid>

| | |
|---|---|
| Y type titanylphthalocyanine showing the angle 2θ of the highest X-ray diffraction peak of Cu-Kα characteristic X-ray at 27.3° | 60 g |
| Silicone resin solution: KR5240, 15% xylene-butanol solution (Shin' etsu Kagaku Co., Ltd.) | 700 g |
| 2-butanone | 2000 ml |

The following composition was mixed and dissolved to prepare a charge transfer layer coating liquid. The coating liquid was coated on the charge generation layer by the immersion method to form a charge transfer layer with a dry thickness of 20 μm.

<Charge Transfer Layer (CTL) Coating Liquid>

| | |
|---|---|
| Charge transfer material: 4-methoxy-4'-(4-methyl-α-phenylstyryl)triphenylamine | 200 g |
| Bisphenol Z type polycarbonate: IUPILON Z-300 (Mitsubishi Gas Kagaku Co., Ltd.) | 300 g |

-continued

| | |
|---|---|
| Hindered amine: SANOL LS2626 (Sankyo Co., Ltd.) | 3 g |
| 1,2-dichloroethane | 2000 ml |

<Surface Protective Layer>

| | |
|---|---|
| Charge transfer material: 4-methoxy-4'-(4-methyl-α-phenylstyryl)triphenylamine | 200 g |
| Bisphenol Z type polycarbonate: Iupilon Z-300 (Mitsubishi Gas Kagaku Co., Ltd.) | 300 g |
| Hindered amine: Sanol LS2626 (Sankyo Co., Ltd.) | 3 g |
| Poly(tetrafluoroethylene resin particle (average particle diameter of 0.5 μm) | 100 g |
| 1-butanol | 50 g |

The above composition was mixed and dissolved to prepare a surface protective layer coating liquid. The coating liquid was coated on the charge transfer layer by the immersion coating method and the coated layer was thermally hardened for 40 minutes at 100° C. to form a surface protective layer having a dry thickness of 4 μm. Thus a photoreceptor was prepared.

(Evaluation by Practical Image Taking)

An electrophotographic full color composite machine 8050, manufactured by Konica Minolta Corp., was modified by installing a polyimide intermediate transfer member and a fixing device having the constitution of FIG. 1 in which a pressing member for fixing made of polyimide resin was used. Practical image taking tests were carried out by employing the modified machine for performing evaluations as to the following items. Inside of the pressing member for fixing, dimethylsilicone oil having a viscosity of 3,000 cs was coated.

A cleaning blade and a cleaning brush were touched to the photoreceptor and a PET sheet in which silica was dispersed was touched to the intermediate transfer belt surface for polishing the surface.

(Occurrence of Filming)

After printing out of 200,000 sheets of color images having a pixel ratio of 20% and then 10,000 sheets of monochromatic documents were continuously printed at 25° C. and 85% RH. After that, a cyan halftone image was printed on full size of the paper.

A: Good image without unevenness was output.

B: The image was roughened a little compared with the image before the test but no problem was posed for practical use.

C: Line-shaped unevenness was formed in the image and. occurrence of filming at the position corresponding to the unevenness was observed on the intermediate transfer belt, pressing member for fixing or photoreceptor.

(Angle Dependency of Glossiness)

Solid images of Y, M, C, R, G and B were output and evaluated according to the following norms.

A: The impression of the image viewed from the front, that viewed in the direction at an angle of 45° C. by following light and that viewed in the direction at an angle of 45° C. by against light were the same.

B: Though high glossiness was felt when the image was viewed from the front, but the glossiness was different a little when the image is carefully view from the direction at angle of 45° C. by flowing light or by against light.

C: The impression of the image viewed from the front was obviously different from that when the image was viewed in the direction at an angle of 45° C. by following light or by against light.

(Deformation and Color Displacement)

Unfixed and fixed images printed by the printer after printing of 200,000 sheets were compared.

A: The shapes of the dots were the same and color displacement was not observed.

B: Some of the dots were expanded or diminished a little in the direction of conveying but color displacement was not observed; acceptable for practical use.

C: Dots expanded or diminished in the conveying direction were observed and the color displacement was caused.

(Glossiness)

An A3 size image having a pixel ratio of 50% was formed on the following three kinds of transfer paper and the difference of the glossiness at the solid image portion and the white portion (the paper surface without adhering toner) was visually evaluated.

(1) Glossy paper POD Supergloss 170 having a weight of 128 g/m$^2$ and a thickness of 0.17 mm, manufactured by Oji Seishi CO., Ltd.

(2) Semi glossy paper POD Supergloss 100 having a weight of 100 g/m$^2$ and a thickness of 0.1 mm, manufactured by Oji Seishi CO., Ltd.

(3) Matt paper POD Mattcoat 100 having a weight of 128 g/m$^2$ and a thickness of 0.17 mm, manufactured by Oji Seishi CO., Ltd.

A: Any difference between the glossiness at the image portion and that at the white portion (the surface of the transfer paper) was not sensed and incompatibility was not felt at all. Namely, the glossy image is obtained on the glossy paper, the semi-matt toner image was obtained on the semi-matt paper and the matt toner mage was obtained on the matt paper.

B: Though it was sensed on the matt paper that the glossiness of the image portion was higher than that of the white portion, and the incompatibility was almost not felt.

C: The glossiness of the toner image was insufficient on the glossy paper and the glossiness of the toner image was prominence on the matt image, and the image was lacked in substantial feel and gave incompatibility impression.

(Color Gamut)

The fixing temperature in each of the image forming unit was set at 140° C. and each of the primary colors of magenta (M), cyan (C) and yellow (Y), and each of the secondary colors of red (R), blue (B) and green (G) formed by piling the primary colors in a ratio of 1:1 were printed out. Art paper Tokubishi Art Paper, manufactured by Mitsubishi Seishi Co., Ltd., and C2r Paper(Smoothness 28), manufactured by Fuji-Xerox Office Supply Co., Ltd., were employed. Japan Color is the color selected as standard color in Japan by the Japanese Domestic Committee of the Graphic Technology Committee of International Organization for Standardization (ISO/TC130). Lithographic inks for sheet printing considered as most the standard were collected from eight typical ink makers in Japan and measuring the color values thereof under the same extending condition. Japan Color was proposed to the Graphic Technology Committee of International Organization for Standardization (ISO) in 1990. After that Japan Color was revised and Japan Color 2002 became the present standard of color in Japan. Standard samples of Japan Color are supplied from the Japanese Domestic Committee of the Graphic Technology Committee of International Organization for Standardization (ISO/TC130) and easily available.

A: The color gamut the same as in Japan Color 2002 was obtained.

B: Color gamut near Japan Color 2002 could be reproduced but the color gamut of Japan Color 2002 was not exactly satisfied.

C: The color gamut was considerably narrowed compared with Japan Color 2002.

TABLE 3

| | Cyan toner | Magenta toner | Yellow toner | Black toner | Occurrence of filming | Angle dependency of glossiness | Dot deformation and color displacement | Glossiness | Color gamut |
|---|---|---|---|---|---|---|---|---|---|
| No. 1 | C-1 | M-1 | Y-1 | Bk-1 | A | A | A | A | B |
| No. 2 | C-2 | M-2 | Y-2 | Bk-2 | A | A | B | A | B |
| No. 3 | C-3 | M-3 | Y-3 | Bk-3 | A | A | A | A | A |
| Comparative 1 | c-1 | m-1 | y-1 | bk-1 | B | B | C | B | B |
| Comparative 2 | c-2 | m-2 | y-2 | bk-2 | B | B | B | C | C |
| Comparative 3 | c-3 | m-3 | y-3 | bk-3 | C | C | B | B | B |

As is displayed in Table 3, Nos. 1 through 3 show excellent effects in the entire evaluation items.

Example 2

(Preparation or Low Molecular Weight Resin Particle)

Resin Particle Dispersion L-1

| | |
|---|---|
| Styrene | 322.3 g |
| n-butyl acrylate | 121.9 g |
| Methacrylic acid | 35.5 g |

In a 5,000 ml separable flask attached with a stirring device, thermal sensor and cooling tube, 2.5 g of the surfactant 101 was dissolved in 1340 g of deionized water to form a surfactant solution. The above surfactant solution was heated by 80° C., and the above polymerizable monomer solution was dispersed for 2 hours in the surfactant solution by the mechanical dispersing machine CLEARMIX, manufactured by M•Technique Co., Ltd., having a circulating pass to prepare an emulsion (dispersion) containing emulsified particles (oil droplets) having a diameter for 182 nm.

Thereafter, 1460 ml of deionized water was added and then an initiator solution of 7.5 g of polymerization initiator (potassium persulfate: KPS) dissolved in 142 ml of deionized water and 6.6 g of n-octanethiol were added, and then polymerization was performed by heating and stirring the system for 3 hours at 80° C. to obtain resin particles (a dispersion of low molecular weight resin particles).

(Preparation of Toner)

<<Toner C-11>>

(Preparation of Resin Particle Dispersion)

Preparation of Resin Particle

In a flask attached with a stirring device, 162.0 g of parting agent composed of 88 parts by weight of stearyl stearate, 6 parts by weight of behenyl stearate, 3 parts by weight of stearyl behenate, and 3 parts by weight of behenyl behenate were added to the following composition and dissolved by heating by 75° C. The solution was referred to as Polymerizable Monomer Solution 1-1.

| | |
|---|---|
| Styrene | 172.9 g |
| n-butyl acrylate | 55.0 g |
| Methacrylic acid | 23.1 g |

Besides, in a 5,000 ml separable flask, to which a stirring device, a thermal sensor and a cooling tube were attached, 2.5 g of anionic surfactant 101 ($C_{12}H_{25}(OCH_2CH_2)_2OSO_3Na$) was dissolved in 1340 g of deionized water to prepare a surfactant solution. The surfactant solution was heated by 80° C. and Polymerizable Monomer Solution 1-1 was mixed and dispersed for 2 hours in the surfactant solution by a mechanical dispersing machine having a circulation pass CLEARMIX manufactured by M•Technique Co., Ltd., to prepare an emulsion (suspension) containing emulsified particles (oil droplets) having a diameter of 482 nm.

Thereafter, 1460 ml of deionized water was added and then an initiator solution of 7.5 g a polymerization initiator (potassium persulfate: KPS) dissolved in 142 ml of deionized water and 6.47 g of n-octanethiol were further added. Polymerization. (the first step polymerization) was performed by heating and stirring the system at 80° C. for 3 hours. Thus resin particles (dispersion of polymer particles) were obtained, which was referred to as Resin Particle 1-1.

To the dispersion, an initiator solution of 11.6 g of initiator KPS dissolved in 220 ml of deionized water was added and then the following Polymerizable Monomer solution 1-2 was dropped spending for 1 hour under a temperature condition of 80° C.

(Polymerizable Monomer Solution 1-2)

| | |
|---|---|
| Styrene | 291.2 g |
| n-butyl acrylate | 132.2 g |
| Methacrylic acid | 42.9 g |
| n-octanethiol | 12.52 g |

After completion of the dropping, polymerization (the second step of polymerization) was carried out by heating and stirred for 2 hours and then cooled by 28° C. to obtain a dispersion of resin particle 1-2 using the resin particle 1-1 as the raw material.

(Preparation of Colorant Dispersion)

To a solution of 59.0 g of Surfactant 101 dissolved in 1,600 ml of deionized water, 280.0 g of C. I. Pigment Blue 15:1 was gradually added while stirring the solution and then dispersed by CLEARMIX, manufactured by M•Technique Co., Ltd., to prepare a dispersion of the colorant. The particle diameter of the colorant dispersion was 93 nm. The dispersion was referred to as Colorant Dispersion c-1.

(Association Process)

In a four-mouth flask attached with a thermal sensor, a cooler, a nitrogen gas introducing device and a stirring device, 259.3 g (in terms of solid component) of Resin particle 1-2 for inner layer, 1,120 ml of deionized water and 237 g of the above colorant dispersion were charged and stirred. After adjusting the interior temperature of the flask at 30° C., a 5 moles/liter aqueous solution of sodium hydroxide was added to adjust the pH value to 10.

Then 20.1 g of a 10 weight-% solution of poly(aluminum chloride) was added spending for 10 minutes while stirring at 30° C. After standing for 3 minutes, heating of the system was begun and the temperature was raised by 90° C. spending for 60 minutes for performing the association of the resin particle 1-2 and the colorant particles.

The particle diameter of the colored particle ml for forming the inner layer was measured by COULTER COUNTER TA-II, manufactured by Beckman Coulter Co., Ltd., while stirring and heating, and a solution of 15.3 g of sodium chloride dissolved in 100 ml of deionized water was added at a time when the volume diameter (Dv50) become to 4.5 μm to inhibit the growing of the particle.

The stirring and heating were further continued for 1 hour or more and the later-described resin particle dispersion for outer layer S-1 was separately added for four times by one fourth amount when the circular degree become to 0.944 so that the resin particles s1 for outer layer were fused. The circular degree after the final addition of the resin particle s1 for outer layer was 0.995. Thus obtained liquid was referred to as Toner Particle Dispersion C-1.

(Resin Particle for Outer Layer S-1)

| | |
|---|---|
| Styrene | 322.3 g |
| n-butyl acrylate | 121.9 g |
| Methacrylic acid | 35.5 g |

In a 5,000 ml separable flask attached with a stirring device, thermal sensor and cooling tube, 2.5 g of the surfactant 101 was dissolved in 1340 g of deionized water to form a surfactant solution. The surfactant solution was heated by 80° C., and the above polymerizable monomer solution was dispersed for 2 hours in the surfactant solution by the mechanical dispersing machine CLEARMIX, manufactured by M•Technique Co., Ltd., having a circulating pass to prepare an emulsion (dispersion) containing emulsified particles (oil droplets) having a diameter for 182 nm.

Thereafter, 1460 ml of deionized water was added and then an initiator solution of 7.5 g of polymerization initiator (potassium persulfate: KPS) dissolved in 142 ml of deionized water and 6.6 g of n-octanethiol were added, and then polymerization was performed by heating and stirring the system for 3 hours at 80° C. to obtain resin particles (a dispersion of low molecular weight resin particles).

(Solid-Liquid Separation, Drying Process)

The dispersion of Toner Particle C-1 was subjected to centrifugal dehydration and washed while pouring deionized water of 40° C. and then dried by wind heated at 40° C. Thus Toner Particle C-1 was obtained.

(External Additive Mixing Process)

To the above Toner Particle C-1, 0.8 parts by weight of hydrophobic silica having a primary particle diameter of 14 nm, 1.0 part by weight of needle-shaped hydrophobic titanium oxide, 1.0 part by weight of hydrophobic silica having a primary particle diameter of 85 nm, 1.0 part by weight of hydrophobic silica having a primary particle diameter of 140 nm, 0.11 parts by weight of oleic acid, 0.05 parts by weight of palmitic acid, 0.07 parts by weight of stearic acid and 0.03 parts by weight of myristic acid were added and mixed for 5 minutes by a HENSCHEL-MIXER at a circumference speed of the rotating wings of 30 m/sec. By the above processing, Toner C-11 can be prepared from Toner Particle C-1. The average value of the circular degree of the toner particles, the volume diameter (Dv50) of the toner, the temperature of the endothermic peak and the amount of endothermic heat measured by DSC.

<<Toner M-1>>

Toner M-1 was obtained in the same manner as in the preparation of colorant dispersion of Toner C-11 except that 420 g of C. I. Pigment Red 184 was employed in place of 280.0 g of C. I. Pigment Blue 15:1.

<<Toner Y-1>>

Toner Y-1 was obtained in the same manner as in the preparation of colorant dispersion of Toner C-11 except that 420 g of C. I. Pigment Yellow 74 was employed in place of 280.0 g of C. I. Pigment. Blue 15:1.

<<Toner Bk-1>>

Toner Bk-1 was obtained in the same manner as in the preparation of colorant dispersion of Toner C-11 except that 420 g of neutral carbon black REGAL 660, manufactured by Cabot Co., Ltd., was employed in place of 280.0 g of C. I. Pigment Blue 15:1.

<<Toner C-12>>

Toner C-12 was prepared in the same manner as in Toner C-11 except that the adding amount of n-octanethiol is changed from 12.52 g to 10.84 g.

<<Toner M-2>>

Toner M-2 was prepared in the same manner as in Toner C-12 except that 40 g of the following compound was employed as the magenta pigment in place of 280.0 g of C. I. Pigment Blue 15:1.

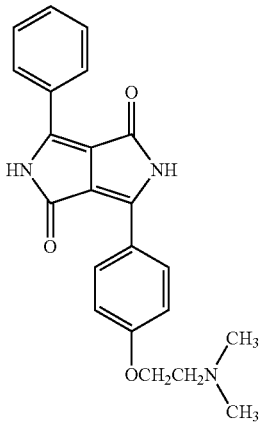

<<Toner Y-2>>

Toner M-2 was prepared in the same manner as in the preparation of colorant dispersion of Toner C-12 except that 420 g of C. I. Pigment Yellow was employed as the yellow pigment in place of 280.0 g of C. I. Pigment Blue 15:1.

<<Toner Bk-2>>

Toner Bk-2 was prepared in the same manner as in the, preparation of colorant dispersion of Toner C-12 except that 420 g of REGAL 660, manufactured by Cabot Co., Ltd., was employed as the black pigment in place of 280.0 g of C. I. Pigment Blue 15:1.

<<Comparative Toners c-11 through bk-1>>

Comparative Toner c-11 was prepared in the same manner as in Toner C-11 except that 162 g of an acid-modified paraffin having a melting point of 97° C. was employed in place of 162.0 g of the parting agent (88 parts by weight of stearyl stearate, 6 parts by weight of behenyl stearate, 3 parts by weight of stearyl behenate and 3 parts by weight of behenyl behenate). Comparative Toners m-1 through bk-1 were prepared by applying the same change to Toners M-1 through Bk-1, respectively.

<<Comparative Toner c-12 through bk-2>>

Toner c-12 was prepared in the same manner as in Toner C-11 except that the combination of the parting agents was changed as shown in Table 4-2 and the adding amount of n-octanethiol in the preparation of Resin Particle 1-2 was changed from 12.52 g to 6.89 g. Comparative Toners m-2 through bk-2 were prepared by applying the same changing.

<<Comparative Toner c-13 through bk-3>> toner c-13 was prepared in the same manner as in Toner C-11 except that the combination of the parting agents was changed as shown in Table 4-2 and the adding amount of n-octanethiol in the preparation of Resin Particle 1-2 was changed from 12.52 g to 14.73 g. Comparative Toners m-3 through bk-3 were prepared by applying the same changing.

TABLE 4

| Name of toner | Parting agent 1 (parts by weight) | Parting agent 2 (parts by weight) | Parting agent 3 (parts by weight) | Parting agent 4 (parts by weight) | Total adding amount of parting agents (g) |
|---|---|---|---|---|---|
| Toner C-11 | Stearyl stearate (88) | Behenyl stearate (6) | Stearyl behenate (3) | Behenyl behenate (3) | 162 |
| Toner M-1 | Stearyl stearate (88) | Behenyl stearate (6) | Stearyl behenate (3) | Behenyl behenate (3) | 162 |
| Toner Y-1 | Stearyl stearate (88) | Behenyl stearate (6) | Stearyl behenate (3) | Behenyl behenate (3) | 162 |
| Toner Bk-1 | Stearyl stearate (88) | Behenyl stearate (6) | Stearyl behenate (3) | Behenyl behenate (3) | 162 |
| Toner C-12 | Stearyl stearate (3) | Behenyl stearate (6) | Stearyl behenate (3) | Behenyl behenate (88) | 162 |
| Toner M-2 | Stearyl stearate (3) | Behenyl stearate (6) | Stearyl behenate (3) | Behenyl behenate (88) | 162 |
| Toner Y-2 | Stearyl stearate (3) | Behenyl stearate (6) | Stearyl behenate (3) | Behenyl behenate (88) | 162 |
| Toner Bk-2 | Stearyl stearate | Behenyl stearate | Stearyl behenate | Behenyl behenate | 162 |

TABLE 4-continued

| Name of toner | Parting agent 1 (parts by weight) | Parting agent 2 (parts by weight) | Parting agent 3 (parts by weight) | Parting agent 4 (parts by weight) | Total adding amount of parting agents (g) |
|---|---|---|---|---|---|
| | (3) | (6) | (3) | (88) | |
| Comparative Toner c-11 | Acid-modified paraffin wax (100) | None | None | None | 162 |
| Comparative Toner m-1 | Acid-modified paraffin wax (100) | None | None | None | 162 |
| Comparative Toner y-1 | Acid-modified paraffin wax (100) | None | None | None | 162 |
| Comparative Toner bk-1 | Acid-modified paraffin wax (100) | None | None | None | 162 |
| Comparative Toner c-12 | Stearyl stearate (88) | Behenyl stearate (6) | Stearyl behenate (3) | Behenyl behenate (3) | 108 |
| Comparative Toner m-2 | Stearyl stearate (88) | Behenyl stearate (6) | Stearyl behenate (3) | Behenyl behenate (3) | 108 |
| Comparative Toner y-2 | Stearyl stearate (88) | Behenyl stearate (6) | Stearyl behenate (3) | Behenyl behenate (3) | 108 |
| Comparative Toner bk-2 | Stearyl stearate (88) | Behenyl stearate (6) | Stearyl behenate (3) | Behenyl behenate (3) | 108 |
| Comparative Toner c-13 | Stearyl stearate (88) | Behenyl stearate (6) | Stearyl behenate (3) | Behenyl behenate (3) | 224 |
| Comparative Toner m-3 | Stearyl stearate (88) | Behenyl stearate (6) | Stearyl behenate (3) | Behenyl behenate (3) | 224 |
| Comparative Toner y-3 | Stearyl stearate (88) | Behenyl stearate (6) | Stearyl behenate (3) | Behenyl behenate (3) | 224 |
| Comparative Toner bk-3 | Stearyl stearate (88) | Behenyl stearate (6) | Stearyl behenate (3) | Behenyl behenate (3) | 224 |

TABLE 5

| | | | | | Measured by DSC | | | | Difference of the largest |
|---|---|---|---|---|---|---|---|---|---|
| | | | | | In heating course | | In cooling course | | peak in |
| | Peaks in molecular weight distribution | | Average value of circular | Volume particle diameter (Dv50) | Endothermic peaks number between 50 to 73° C. | Endothermic heat amount | Endothermic peaks number between 45 to 70° C. | Endothermic heat amount | heating course and that in cooling |
| Toner | Peak 1 | Peak 2 | degree | (μm) | (lines) | (J/mg) | (lines) | (J/mg) | course |
| C-1 | 11500 | 1640 | 0.995 | 4.8 | 65 (3) | 18.4 | 61 (3) | 18.2 | *1 |
| M-1 | 11500 | 1672 | 0.996 | 4.7 | 65 (3) | 18.4 | 61 (3) | 18.2 | *1 |
| Y-1 | 11400 | 1630 | 0.997 | 4.7 | 65 (3) | 18.4 | 61 (3) | 18.1 | *1 |
| Bk-1 | 11400 | 1630 | 0.998 | 4.9 | 65 (3) | 18.3 | 61 (3) | 18.1 | *1 |
| C-2 | 17000 | 1690 | 0.981 | 5.4 | 71 (3) | 17.8 | 56 (3) | 17.6 | *1 |
| M-2 | 17050 | 1720 | 0.982 | 5.4 | 71 (3) | 17.8 | 66 (3) | 17.6 | *1 |
| Y-2 | 17000 | 1660 | 0.983 | 5.3 | 71 (3) | 17.8 | 66 (3) | 17.6 | *1 |
| Bk-2 | 17050 | 1760 | 0.981 | 5.8 | 71 (3) | 17.8 | 66 (3) | 17.6 | *1 |
| c-1 | 11500 | None | 0.960 | 5.4 | 97 (1) | 15.1 | 85 (1) | 15.1 | Equal |
| m-1 | 11500 | None | 0.958 | 5.4 | 97 (1) | 15.2 | 85 (1) | 15.2 | Equal |
| y-1 | 11500 | None | 0.957 | 5.4 | 97 (1) | 15.4 | 85 (1) | 15.4 | Equal |
| bk-1 | 11400 | None | 0.958 | 5.4 | 97 (1) | 15.1 | 85 (1) | 15.1 | Equal |
| c-2 | 9800 | 1690 | 0.998 | 4.2 | 65 (3) | 12.3 | 61 (3) | 12.1 | *1 |
| m-2 | 9800 | 1680 | 0.998 | 4.2 | 65 (3) | 12.3 | 61 (3) | 12.2 | *1 |
| y-2 | 9800 | 1670 | 0.998 | 4.1 | 65 (3) | 12.2 | 61 (3) | 12.1 | *1 |
| bk-2 | 9800 | 1700 | 0.998 | 4.3 | 65 (3) | 12.3 | 61 (3) | 12.2 | *1 |
| c-3 | 19000 | 1690 | 0.953 | 6.9 | 65 (3) | 25.4 | 61 (3) | 18.2 | *1 |

TABLE 5-continued

| Toner | Peaks in molecular weight distribution Peak 1 | Peak 2 | Average value of circular degree | Volume particle diameter (Dv50) (μm) | Measured by DSC In heating course Endothermic peaks number between 50 to 73° C. (lines) | Endothermic heat amount (J/mg) | In cooling course Endothermic peaks number between 45 to 70° C. (lines) | Endothermic heat amount (J/mg) | Difference of the largest peak in heating course and that in cooling course |
|---|---|---|---|---|---|---|---|---|---|
| m-3 | 19000 | 1600 | 0.954 | 6.9 | 65 (3) | 25.4 | 61 (3) | 18.2 | *1 |
| y-3 | 19000 | 1650 | 0.953 | 6.9 | 65 (3) | 25.4 | 61 (3) | 18.2 | *1 |
| bk-3 | 19000 | 1690 | 0.951 | 7.0 | 65 (3) | 25.4 | 61 (3) | 18.2 | *1 |

*1: Larger in cooling course (Preparation of Developer)

The developer was prepared in the same manner as in Example 1.

(Preparation of Photoreceptor)

The photoreceptors were prepared in the same manner as in Example 1.

(Evaluation by Practical Image Taking)

Practical image taking tests were carried out by using a full color electrophotographic composite machine C2425, manufactured by Fuji Xerox Co., Ltd., for evaluating as to the following items. Dimethylsilicone oil having a viscosity of 3 Pa·s was coated on the inner wall of the pressing member for fixing.

Any cleaning blade and cleaning brush were not attached to the photoreceptor and the intermediate transfer member on the occasion of the evaluation.

(Unevenness in Glossiness)

A: Unevenness in glossiness could not be detected at all.

B: Unevenness in glossiness could not be detected at all as long as not enlarged by a loupe.

C: Line shaped unevenness in glossiness can be observed by visual observation.

(Angle Dependency of Glossiness)

The evaluation was carried out according to the same norms as in Example 1.

(Matching of Glossiness)

The evaluation was carried out according to the same norms as in glossiness in Example 1.

(Color Gamut)

The evaluation was carried out according to the same norms as in Example 1.

(Suitability for Cleaningless Process)

A: The transferring ability was high and any waste toner was not formed by cleaning of the photoreceptor and the intermediate transfer member.

B: The cleaning is not needed for the photoreceptor but needed for the intermediate transfer member.

C: The cleaning was needed for both of the photoreceptor and the intermediate transfer member.

As I shown in Table 6, Examples 1 and 2 display superior effects in the entire evaluation items.

TABLE 6

| Example | Cyan toner | magenta toner | Yellow toner | Black toner | Color gamut | Unevenness in glossiness | Matching of glossiness | Matching of glossiness | Suitability for cleanerless process |
|---|---|---|---|---|---|---|---|---|---|
| Example 1 | C-1 | M-1 | Y-1 | Bk-1 | A | A | B | A | B |
| Example 2 | C-2 | M-2 | Y-2 | Bk-2 | A | A | A | A | A |
| Comparative example 1 | c-1 | m-1 | y-1 | bk-1 | B | C | C | C | C |
| Comparative example 2 | c-2 | m-2 | y-2 | bk-2 | B | C | C | B | C |
| Comparative example 3 | c-3 | m-3 | y-3 | bk-3 | C | B | B | B | C |

what is claimed is:

1. An electrophotographic image forming method comprising the steps of:

developing an electrostatic image on an electrophotographic photoreceptor by a developer containing a toner;

transferring a toner image formed by developing; and fixing the toner image onto a recording medium; wherein the toner contains toner particles having a volume particle diameter (Dv50) of from about 4.4 to about 5.8 μm, and at least two metal soaps selected from the group consisting of an oleate, a palmitate, a stearate and a myristate, and has two or more endothermic peaks measured by DSC being between about 50 to about 73° C. and an endothermic heat amount of about 12.6 to about 24.5 J/mg, and a transferring member used for transfer and/or a fixing member used for fixing are constituted by a belt containing a polyimide resin.

2. The method of claim 1, wherein the average value of the circular degree of the toner particles is from 0.955 to 0.975.

3. The method of claim 2, wherein the electrophotographic photoreceptor includes a charge generation layer containing a gallium phthalocyanine as a charge generation material and a charge transfer layer contains a benzidine compound and/or a triarylamine compound as a charge transporting material.

4. The method of claim 2, further comprising touching a blade, a brush or a polishing sheet with the photoreceptor and/or the transfer member.

5. The method of claim 2, wherein the endothermic peaks measured by DSC being within the range of from the 58 to 71° C. and the amount of the endothermic heat is from 13.6 to 24.5 J/mg.

6. The method of claim 2, wherein the volume particle diameter(DV50) is from 4.7 to 5.4 μm.

7. The method of claim 2, wherein the fixing process includes a process in which the recording material is passed between a heating member and a pressing member constituted by an endless belt.

8. The method of claim 2, wherein the oleate, palmitate, stearate and myristate are metal salts and the metal forming the metal salt is one of aluminum, indium, gallium, zinc, calcium, lithium, magnesium and sodium.

9. The method of claim 2, wherein the toner is a black toner and the method further comprises the steps of developing an electrostatic image corresponding to an yellow image on a second photoreceptor by an yellow toner, developing an electrostatic image corresponding to a cyan image on a third photoreceptor by a cyan toner and developing an electrostatic image corresponding to a magenta image on a fourth photoreceptor by a magenta toner, the transferring a toner image formed by each of the developing steps to an intermediate transfer member and transferring each of the toner images to the recording medium.

10. The method of claim 9, wherein the yellow, cyan and magenta toner each contains toner particles, the toner particles of each toner having a volume particle diameter (Dv50) of from 4.4 to 5.8 μm and at least two endothermic peaks measured by DSC being within the range of from 58 to 71° C. and the endothermic heat amount of from 12.6 to 24.5 J/mg.

11. The method of claim 9, wherein the transfer member is the intermediate transfer member.

12. The method of claim 11, wherein the fixing step includes passing the recording medium between the fixing member and the heating member.

13. The method of claim 12, wherein both of the fixing member and the intermediate transfer member are constituted by the polyimide belts.

14. The method of claim 2, wherein the fixing step includes passing the recording medium between the fixing member and the heating member.

15. The method of claim 1, wherein tetrahydrofuran soluble components of the toner has peaks within the range of from 11,000 to 18,000 and that of from 500 to 2,000 in molecular weight distribution, and the toner has two or three endothermic peaks in the heating course measured by DSC being within the range of from 50 to 73° C. and the endothermic heat amount thereof is from 12.6 to 24.5 J/mg and the toner has 1 to 3 exothermic peaks in the cooling course measured by DSC being within the range of from 45 to 70° C., and the half band width of the largest exothermic peak in the cooling course is larger than the half band width of the largest endothermic peak in the heating course.

16. The method of claim 15, wherein the fixing member used for the fixing is constituted by the polyimide belt.

17. The method of claim 15, wherein tetrahydrofuran soluble components of the toner have peaks within the range of from 14,000 to 17,000 and that from 500 to 1,000 and a dip formed by the two peaks is within the range of from 1,200 to 3,000, and the tetrahydrofuran soluble components having a dissolution starting molecular weight is within the range of from 100,000 to 1,500,000 in the molecular weight distribution.

18. The method of claim 15, wherein the average value of the circular degree of the toner particles is from 0.979 to 0.996, and the toner has two or three endothermic peaks on the course of heating measured by DSC being within the range of 50 to 71° C., and the endothermic heat amount thereof is from 13.4 to 24.5 J/mg.

19. The method of claim 15, wherein the toner is a magenta toner containing a) a combination of a quinacridone pigment and a diketopyrrole or a strontium salt of a carmine pigment or b) a combination of C. I. Pigment Red 31 and C. I. Pigment Red 150.

20. The method of claim 15, wherein the toner is a black toner and the method further comprises the steps of developing an electrostatic image corresponding to an yellow image on a second photoreceptor by an yellow toner, developing an electrostatic image corresponding to a cyan image on a third photoreceptor by a cyan toner and developing an electrostatic image corresponding to a magenta image on a fourth photoreceptor by a magenta toner, the transferring a toner image formed by each of the developing steps to a first intermediate transfer member and transferring each of the toner images to a recording medium.

21. The method of claim 20, wherein the yellow, cyan and magenta toner each contains toner particles, the toner particles of each toner have a volume particle diameter (Dv50) of from 4.4 to 5.8 μm and at least two endothermic peaks measured by DSC being within the range of from 50 to 73° C. and the endothermic heat amount of from 12.6 to 24.5 J/mg.

* * * * *